United States Patent [19]

Schulzke et al.

[11] 4,180,026

[45] Dec. 25, 1979

[54] APPARATUS FOR CONTROLLING THE OPERATING CURRENT OF ELECTROMAGNETIC DEVICES

[75] Inventors: Peter Schülzke, Oberriexingen; Herbert Arnold, Eberdingen; Klaus Harsch, Ditzingen; Peter Werner, Stuttgart, all of Fed. Rep. of Germany

[73] Assignee: Robert Bosch GmbH, Stuttgart, Fed. Rep. of Germany

[21] Appl. No.: 781,808

[22] Filed: Mar. 28, 1977

[30] Foreign Application Priority Data

Mar. 26, 1976 [DE] Fed. Rep. of Germany ..... 2612914
Feb. 16, 1977 [DE] Fed. Rep. of Germany ..... 2706436

[51] Int. Cl.[2] ..... F02M 51/00; H01F 7/18
[52] U.S. Cl. ..... 123/32 EF; 361/154
[58] Field of Search ..... 123/32 EF, 32 EA; 361/154, 194; 251/129, 141

[56] References Cited

U.S. PATENT DOCUMENTS

| | | | |
|---|---|---|---|
| 2,934,050 | 4/1960 | Pribble | 123/32 EA |
| 3,665,901 | 5/1972 | Monpetit et al. | 123/32 EF |
| 3,682,144 | 8/1972 | Suda | 123/32 EF |
| 3,768,449 | 10/1973 | Lindberg | 123/32 EF |
| 3,786,314 | 1/1974 | Misch | 361/154 |
| 3,786,344 | 1/1974 | Davis et al. | 123/32 EF |
| 3,889,162 | 6/1975 | Myers | 123/32 EF |
| 3,896,346 | 7/1975 | Ule | 361/154 |
| 4,078,528 | 3/1978 | Hoshi | 123/32 EF |

*Primary Examiner*—Charles J. Myhre
*Assistant Examiner*—Andrew M. Dolinar
*Attorney, Agent, or Firm*—Edwin E. Greigg

[57] ABSTRACT

Electronic control circuitry is provided for controlling the actuating current of electromagnetic devices and in particular of the electromagnetic fuel injection valves of an internal combustion engine. In order to program the magnitude of the actuating current from an initial high level to a lower maintenance level, there is provided a driver circuit which receives fuel injection control pulses from a fuel injection system, not itself part of the invention, and processes these control pulses into valve-actuating current pulses. The valve current is sensed by suitable transducer, for example a resistor, and the resulting signal is fed to a two-point controller which suitably alters the input to the driver circuit to thereby change the valve actuating current. The set-point value on which the two-point controller operates is itself subject to change by means of a suitable circuit. There is further provided a free-running circuit and a quenching circuit for reducing the voltage peaks resulting from the collapse of the magnetic fields stored in the valve actuating coils. Two embodiments are presented.

35 Claims, 14 Drawing Figures

APPARATUS FOR CONTROLLING THE OPERATING CURRENT OF ELECTROMAGNETIC DEVICES

BACKGROUND OF THE INVENTION

The invention relates to an apparatus for controlling the operational current for electromagnetic switching systems, especially of electromagnetic fuel injection valves associated with an internal combustion engine. In operation, the fuel injection valves receive control pulses from a fuel injection control system, and the duration of the pulses is determined on the basis of the air flow rate of the engine and the prevailing rotational speed (rpm).

In general, electromagnetic switching systems, especially relays, control coils, etc., only operate when the control signal reaches a certain level. It is thus of advantage to operate such systems with relatively heavy switching currents so as to prevent any delay in operation. On the other hand, such heavy currents result in a considerable load on the system and on the output circuit when the stationary switching state is reached and maintained. In addition to the heavy power losses, the current-carrying portion of the switching system stores a substantial amount of energy which may become a disturbing factor at the time of turn-off. A further disadvantage of using a heavy turn-on current is to generate a substantial delay when the system, especially a control valve, is turned off.

OBJECT AND SUMMARY OF THE INVENTION

It is thus a principal object of the present invention to provide an electrical control system for electromagnetic devices which provides that the control current is subjected to a specified regime. In particular, in a preferred exemplary embodiment of the invention, it is provided that the output power stage reduces a high initial current very rapidly to a predetermined maintenance current. When the invention is used in the special case of fuel injection valves, the energy content of the electromagnetic switching system is reduced. Furthermore, one side of the valves may be directly connected to the supply voltage, and the controller which operates the power output stage may receive a control signal close to ground and thus easily processed.

The apparatus according to the present invention uses a very high value of initial current and thus produces a very short turn-on delay. Once the valve has been operated, however, it is possible to reduce the current just above the level where the valve is still securely held open. Furthermore, the lowered value of the maintenance current also results in a short turn-off time because the energy stored in the magnetic field is relatively small. In a further feature of the invention, there is provided a damping circuit for further increasing the rate of decay of the current when the injection control pulse is terminated. It is a particular advantage of the invention that, when used for the operation of electromagnetic valves, especially fuel injection valves, no load resistors are required and the turn-on times of the valves can be made very short. Furthermore, losses in the output power transistor, in the quenching circuit and in the valves themselves are all limited.

It is a further object of the invention to provide a special free-running control which is in turn operated by a delay circuit which delays one edge of the output signal from a nominal value switch circuit. In a manner yet to be explained in detail, the switch-off of the initial current from its high value to the maintenance value is quenched while the free-running circuit is blocked and the output stage can be operated even with relatively short fuel injection control pulses.

The invention will be better understood as well as further objects and advantages thereof become more apparent from the ensuing detailed description of two exemplary embodiments taken in conjunction with the drawing.

DESCRIPTION OF THE PREFERRED EMBODIMENTS

Figure 1:
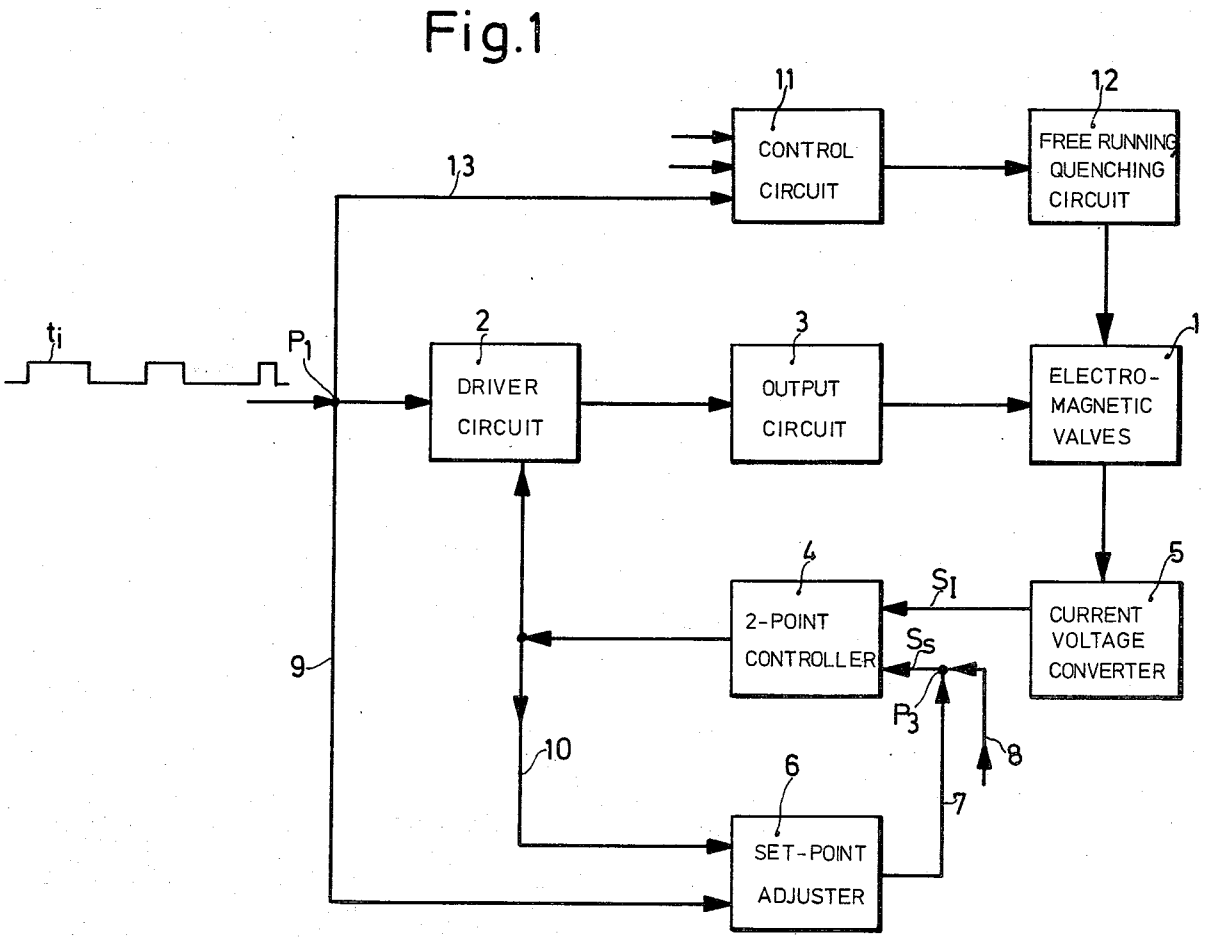
FIG. 1 is a schematic block diagram of a first exemplary embodiment of the invention.

Turning now to FIG. 1, there will be seen a block diagram illustrating the basic conception of the invention which represents a control output circuit for controlling the electromagnetic valves 1 of an internal combustion engine. These valves may be of any known and variable type and construction; in the following preferred exemplary embodiment these valves are the fuel injection valves of an internal combustion engine associated with a fuel injection control system. The valves 1 are electromagnetic valves and can be switched by supplying to them a sequence of injection control pulses.

The series of injection control pulses is fed to the output circuit of FIG. 1 from a fuel injection system the construction of which is not part of this present invention and is generally known. It should be pointed out that the duration of the individual injection control pulses depends substantially on the air quantity aspirated by the engine and on the engine's rotational speed (rpm). The pulse train $t_i$ is fed to the circuit of FIG. 1 at a point P1 where it passes through a driver and logic circuit to an output circuit 3 containing, for example, power transistors and capable of placing the full battery potential on the subsequent electromagnetic valves 1, thereby opening these valves after the appropriate delay in response.

This control circuit, which operates in the forward direction, is associated with a two-point controller 4, preferably having hysteresis, and so located in a feedback branch as to permit the feedback control of the two-point controller 4 in the driver circuit 2. The controller 4 receives an actual value signal $S_I$ and a set point signal $S_S$. The actual value signal $S_I$ reaches the controller 4 via a current-to-voltage converter 5 which monitors the actual valve current $I_V$ and feeds a voltage proportional thereto as an actual value to the controller 4. As long as the actual valve current $I_V$ is smaller than the set-point value, the output of the two-point controller 4 does not alter the prevailing switching state of the driver circuit 2 so that the output circuit 3 remains energized if a control pulse $t_i$ is present at the driver circuit 2. If the set-point value is exceeded, the output of the controller in the driver circuit 2 causes a switch-off of the output circuit 3 and of the output power transistor contained therein. The current in the valves 1 then decays until a lower set-point value of the controller 4 is exceeded in a downward direction. At this point, the controller 4 switches again and releases the output transistor thereby placing battery voltage on the valves 1 and re-initiating the valve current. Thus the control circuit 4, which preferably is a two-point controller having hysteresis, keeps the valve current $I_V$ within a predetermined range as may be seen in the illustration of FIG. 3*b* where the valve current $I_V$ fluctuates between an upper limit $I_3$ and a lower limit $I_2$.

The circuit is so embodied that, when the fuel injection control pulse $t_i$ is absent, the output transistor of the output circuit 3 is blocked regardless of the condition of the controller 4. In a preferred embodiment of the invention, the set-point value $S_S$ fed to the two-point controller 4 may be so changed as to provide a different set-point value for certain periods during the control of the electromagnetic valves. This permits providing a desired control current $I_V$ during the turn-on phase of the valves. The changed set-point is provided by a set-point adjustment circuit 6 which changes the set-point according to any desired function and delivers it to the point $P_3$ of the controller 4. The point $P_3$ may also receive other signals via a line 8 permitting a shift of the set-point. Thus the output valve current $I_V$ may be controlled in a sensitive manner as a function of time.

Preferably, the set-point adjustment circuit 6 is a multivibrator and in the preferred exemplary embodiment shown, the multivibrator 6 so adjusts the set-point $S_S$ fed to the controller 4 that the initial current $I_V$ rises to a relatively high fixed value $I_1$ at the time of arrival of the control pulse $t_i$. The primary elevated current is responsible for a very short response time of the valve 1. Once the valve has responded, i.e., has opened in the present example, the current may be reduced to a second value $I_2$ (see FIG. 3*b*) which is substantially higher than the maintenance value of the current for the valve, thereby preventing the re-closure of the valve. It may be seen that the multivibrator 6 receives the injection control pulse $t_i$ via a line 9 permitting the controller 4 to receive a first set-point when the pulse $t_i$ begins. Preferably, the multivibrator 6 then automatically switches to a second set-point when the valve control current has reached its first level.

Finally, the circuit of FIG. 1 also includes elements 11 and 12 associated with the valves 1 and partially determined by the control pulse $t_i$ via a line 13. These circuits contain a free-running circuit and a quenching circuit which will be discussed in more detail below. When the valve current $I_V$ has been cut off, the quenching circuit damps the current which is induced by the collapsing magnetic field in the valve control coils. The free-running circuit is selectively operated by the logic circuit 11 and receives a current which is generated when the output circuit 3 is turned off by the controller 4. At the end of the injection control pulse $t_i$, a switch-over occurs from the free-running circuit to the quenching circuit.

As will be explained in more detail below, the circuit of FIG. 1 permits the control of the current for the valves 1 according to any desired curve as a function of time and in particular permits this control during the initial rise of the current.

Figure 2:
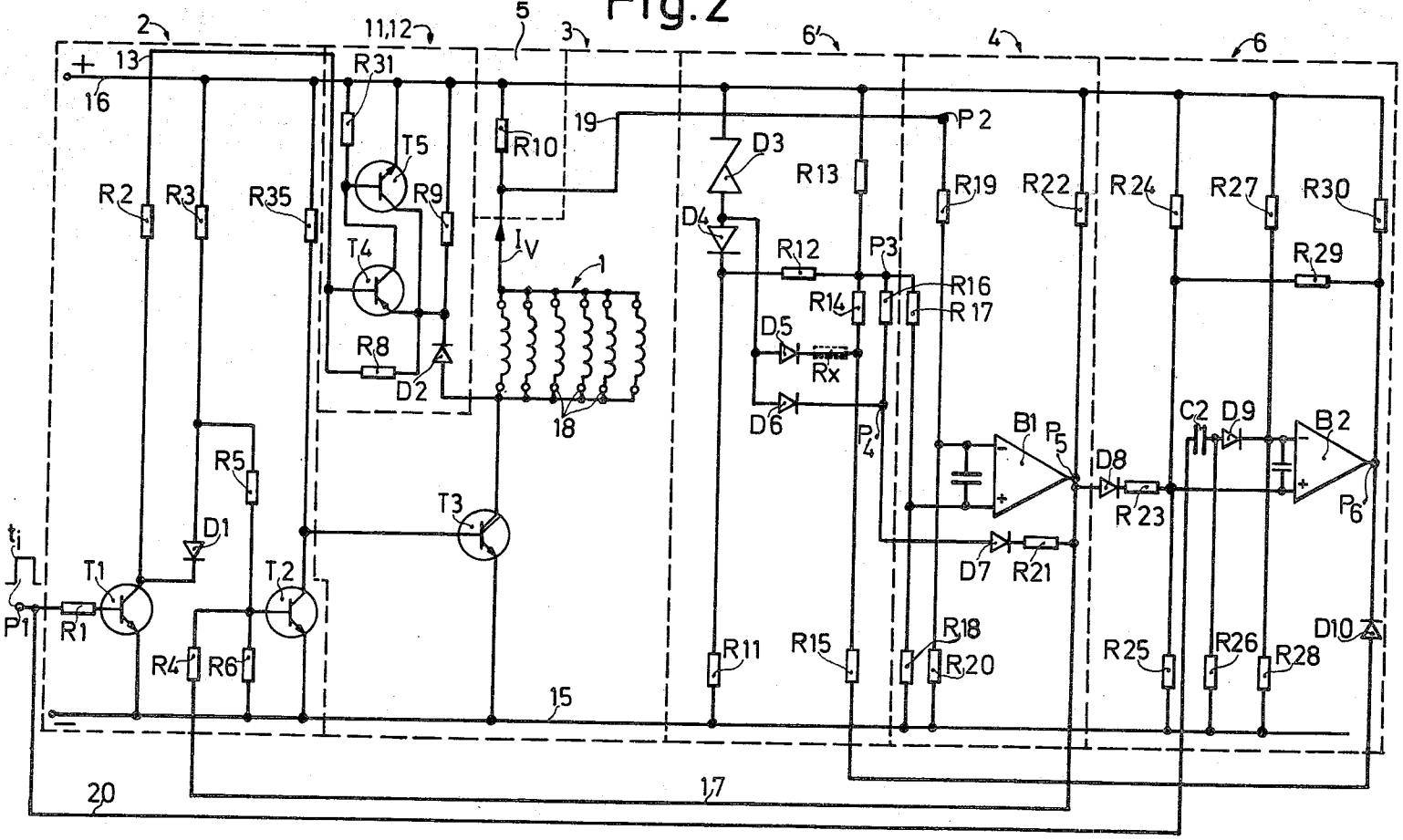
FIG. 2 is a detailed circuit diagram of the various circuits of FIG. 1.

A detailed exemplary embodiment of one possible circuit is given in FIG. 2 in which the building blocks previously discussed in FIG. 1, are bordered by dash-dotted lines and carry the same numerals.

The following description will relate to the basic construction of the current-controlled output circuit of FIG. 2 which is employed for the control of electromagnetic switching valves, whereas the operation of the individual sub-circuits will be discussed in connection with their description or further below in an overall consideration of the functions performed by the system and illustrated in FIGS. 3–7.

The block 2 of FIGS. 1 and 2 which includes a driver and logical circuit consists of two sequential inverter stages formed, respectively, by transistors T1 and T2. The base of the transistor T1 receives the fuel injection control pulse $t_i$ which is produced on the basis of engine information by circuitry not part of this invention. The pulse $t_i$ passes through an input resistor R1 and is twice inverted by the transistors T1 and T2 and travels from the collector of the transistor T2 to the base of a Darlington type output transistor T3. The emitters of transistors T1 and T2 are connected to ground or to the negative supply line 15 and the collector of the transistor T2 is connected through a resistor R35 to the positive line 16. The collector of the transistor T1 is connected in series with a diode D1 and a resistor R3 to the positive line 16 and the junction of the diode D1 and the resistor R3 is connected through a further resistor R5 to the base of the transistor T2 which is also connected to the minus line 15 via a resistor R6. Finally, the base of the transistor T2 is connected through a resistor R4 to the output P5 of the two-point controller 4 via line 17. A resistor R2 connects the collector of the transistor T1 with the control input of the free-running circuit 12 formed by the transistors T4 and T5. The Darlington transistor T3 of the output circuit 3 is a power switching transistor, the emitter of which is connected to the minus line 15. Connected in series with the collector of the transistor T3 are the coils 18 of the various valves 1 which are operated by this transistor. The coils 18 are connected in parallel and are all connected in series with a transducer or measuring resistor R10 to the positive line 16. The measuring resistor R10 serves in this particular exemplary embodiment as the current-to-voltage converter element 5 of FIG. 1 which produces a voltage drop that is precisely proportional to the prevailing valve current $I_V$. This voltage drop is conducted through a line 19 to the subsequent two-point controller 4 and represents the actual variable of the control loop.

Connected in parallel with the series circuit containing the coils 18 and the measuring resistance R10 is the circuit 11, 12 which contains the quenching circuit and the free-running circuit. The quenching circuit includes the resistor R9 connected in series with a diode D2, in turn connected to the junction of the collector of the output transistor T3 and the coils 18. The polarity of the diode D2 is such that it conducts only if the junction of the coils 18 and the collector of T3 carries a potential which is higher than the battery potential and that occurs only when the transistor T3 blocks and the coils induce a reverse voltage.

The emitter of the transistor T5 of the free-running circuit 12 is at the positive supply line and its collector as well as the emitter of transistor T4 are connected to the junction of the quenching resistor R9 and the diode D2. Inasmuch as the collector of the transistor T4 is always connected to the base of the transistor T5, the latter is always made conducting when the voltage received by the base of the transistor T4 from the collector of T1 through the resistor R2 is so large that the transistor T4 receives base current. This will be true whenever a positive injection pulse $t_i$ is present at the input of the transistor T1 of the driver circuit 2. In this manner, a switchover occurs to the free-running circuit during the duration of the injection pulses $t_i$ because the transistor T4 also switches on the transistor T5 and conducts away the potential at the anode of the diode D2 which is still higher than the voltage of the positive supply line 16 so that, when the output transistor T3 is blocked, the potential at the diode D2 is held to a voltage which lies approximately 2 volts above battery voltage in the present example. When the injection control pulse $t_i$ is terminated, the transistor T1 blocks and no further base current for the transistor T4 may flow through the resistor R2. This is also prevented by the fact that the control voltage at the collector of the transistor T1 is brought via the properly connected diode D1 to the base of the transistor T2; the diode D1 prevents further flow of a base current for the transistor T4 once the transistor T1 has blocked. Thus, when the shut-off voltage peak due to the shut-off of the valves causes the diode D2 to conduct, the transistors T4 and T5 of the free-running circuit remain blocked and the valve current flows through the quenching resistor R9. To insure blockage, the base and emitter of the transistors T4 and T5 of the free-running circuit are connected to one another through resistors R8 and R31, respectively. As already discussed, access to the base of the transistor T2 via the resistor R4 permits blockage of the entire circuit for controlling the valves 1 which consists of the circuit blocks 2 and 3 or more precisely, to block the output transistor T3, provided that a fuel injection pulse $t_i$ is present. If no such fuel injection pulse $t_i$ is present, the driver circuit 2 is so embodied that no engagement is possible through the resistor R4 by the prevailing potential at the output P5 of the two-point controller 4.

The two-point controller 4 preferably includes an operational amplifier or comparator provided by a differential amplifier B1, one input of which receives a set-point value and the other of which receives the actual value from the measuring resistor R10. The actual value is available at the point P2 and its voltage is close to the battery potential $U_B$ and may vary between $U_B$ and $U_B-200$ mV. For improved processing, this voltage is divided by a divider circuit consisting of the resistors R19 and R20 connected to the minus line 15 and the junction of these two resistors is connected to the inverting input of the differential amplifier B1. A similarly constructed voltage divider consisting of resistors R17 and R18 divides the set-point signal present at the point P3, the formation of which will be discussed later, and the junction of the divider resistors R17 and R18 is connected to the non-inverting input of the operational amplifier B1. Depending on whether the actual value is more positive or more negative than the set-point value (i.e., the valve current $I_V$ is smaller or larger than the prevailing set-point), the output P5 of the controller 4 carries negative or positive voltage. If the valve current $I_V$ is larger than the prevailing set-point value, then the voltage at the point P2 and thus at the inverting input is lower than that at the point P3 and at the non-inverting input of the differential amplifier. In that case, the output P5 is at high potential or the positive supply potential, which flows through the resistors R4 to the base of the transistor T2 in the driver circuit 2, thereby causing the latter to conduct and blocking the output transistor T3. This causes a decay of the valve operating current until the voltage at the point P2 and at the negative input of the differential amplifier is more positive than that prevailing at the point P3 and at the positive input of the differential amplifier, in which case the controller output P5 goes to the negative voltage and the transistor T2 is no longer held in the conduction condition via the resistor R4. Accordingly, the transistor T2 blocks and the transistor T3 becomes conducting again, permitting the valve current $I_V$ to rise again. All this takes place during the presence of an injection pulse $t_i$. It should be noted that the Darlington transistor or output transistor T3 switches through to within saturation voltage during the presence of a control pulse $t_i$.

The foregoing relates to the basic operation of the circuit which permits a precise control of the current flowing through the control coils of the valves 1 depending on the output voltage of the controller 4 and permits holding the valve current within any given limits as desired. By changing the set-point value in the controller 4, an upper limit for this current may be set. The free control of the valve current $I_V$ in the manner described above is possible because the rise and decay of the current in the coils of the valves 1 depends on the time constant L/R of the circuit, i.e., in other words, the behavior of the current as a function of time obeys an exponential function during rise and decay, thereby permitting the above-described changes when upper and lower values of current are reached.

The set-point value for the point P3 or for the positive input of the differential amplifier B1 is obtained as a voltage drop across the resistor R13. In the preferred example of FIG. 2, three separate factors may affect the value of the set-point variable although, basically, the set-point at the junction P3 as well as its adjustment etc., can take place by externally taken measures and is entirely arbitrary. The voltage drop across the resistor R13 is obtained by passing through that resistor currents of predetermined magnitude and, in a first variant of this circuit, there is provided a voltage divider circuit consisting of the series connection of a Zener diode D3, a properly connected diode D4 and a resistor R11, all connected between the voltage supply lines 15 and 16. In this manner, there is obtained at the junction of the diode D4 and the resistor R11 a voltage which is approximately independent of temperature and supply voltage drifts. A resistor R12 connected to the cathode of the diode D4 places on the resistor R13 a voltage which provides a first magnitude of the set-point value for the value current.

As already mentioned, after an initial rise, the valve current $I_V$ is maintained within a predetermined band which has a lower limit $I_2$ and an upper limit $I_3$. The above-described circuit consisting of the elements D3, D4, R11, R12 and R13 defines the set-point for the lower limit $I_2$ of the valve current. That limit is provided when the output P5 of the two-point controller and a further output P6 of a subsequent flip-flop 6 are at high potential for the purpose of set-point switchover. If, during the presence of a fuel injection control pulse $t_i$ the actual valve current $I_V$ becomes lower than the value $I_2$, the output P5 of the differential amplifier B1 goes to the negative potential or zero potential as already discussed. That event has an effect on the set-point voltage because the controller output P5 is connected to the point P4 through the series connection of a resistor R21 and a properly connected diode D7 and the point P4 in turn is connected through a resistor R16 with the point P3 that defines the set-point value. Thus, the potential at the point P3 is shifted to more negative values and the shift is limited by a diode D6 connected to the junction of diodes D3 and D4 to a value which is approximately independent of voltage and temperature and which corresponds to the sum of the voltages across the diodes D3 and D6, i.e., $U_{D3}$ and $U_{D6}$ under the present conditions. Thus the resistor R16 forces a different set-point voltage on the resistor R13. The difference between the two set-point voltages at the point P3 which corresponds to the controller output voltages "plus voltage" or "minus voltage" defines the hysteresis limits of the two-point controller and thus the width of the band $I_H=I_3-I_2$ within which the valve current $I_V$ fluctuates. Inasmuch as the potential shifts of the controller output P5 affect the switching state of the output transistor T3, when the current in the valves exceeds the prevailing set-point, it then decays until the lower set-point determined by the hysteresis of the controller is penetrated in the downward direction. In that case, the controller 4 switches over again and releases the output transistor T3 so that the valves are reconnected to the battery voltage and the current begins to rise again (see also FIG. 3*b*). A significant aspect of current-controlled systems for electromagnetic valves is the consideration of the increase or rising behavior of the current because it defines the response time of the entire system.

Accordingly, the starting edge of the injection pulse $t_i$ sets the above-mentioned flip-flop 6 which causes the set-point switchover via the line 20. Once set, the flip-flop 6, which will be discussed in greater detail below, influences the voltage at the circuit point P3 which determines the set-point and represents a third influence on that value with the result that the current in the valves 1 at first rises to a fixed elevated value $I_1$ at each and every injection pulse. It is this high value of the current which, as already mentioned, determines the very short delay in the opening of the valve. Once the valve or valves have operated, the valve actuating current may be lowered to the valve $I_2$ without thereby causing the valve to return to its normal state. The lower current which is furthermore independent of battery voltage insures that the power loss is low and further that the return time of the valve to the normal or unenergized state will be short and independent of battery voltage.

In the first phase, i.e., at the beginning of the injection pulse $t_i$, the output potential of the flip-flop 6 at the point P6 is negative or zero. This potential is carried through the series connection of a diode D10, a resistor R15 and a resistor R14 to the circuit point P3 which determines the set-point voltage. By means of the elements D10, R15 and R14, the resistor R13 receives a determined voltage which defines the set-point during the first and increasing phase of the valve current. Here too, the junction of the resistors R14 and R15 is connected via a diode D5 with the junction of the diodes D3 and D4, thereby limiting the potential shift to the sum of the diode voltages. Thus, in the exemplary embodiment shown, there takes place the parallel addition of three separate influences for the upper limit of $I_1$ as determined by the set-point during the initial increasing phase. Mainly however, the set-point is determined by the elements D10, R15, R14 and D5.

Figure 3:
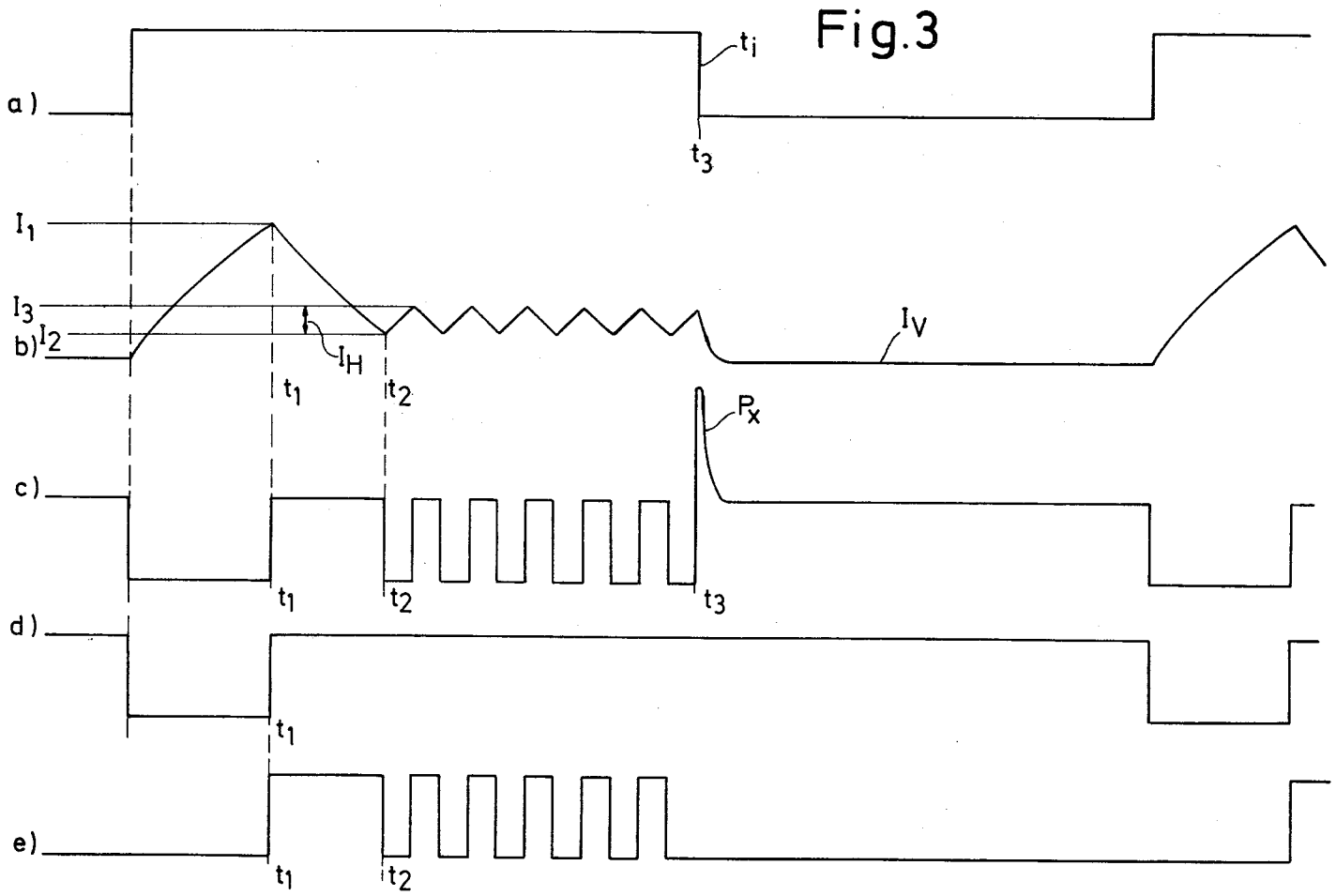
FIG. 3 is a pulse timing diagram illustrating the various currents and voltages as a function of time in the output circuit of FIG. 2.

The diagram of FIG. 3 illustrates the curves of various voltages and currents in the current-controlled output circuit as described so far.

FIG. 3*a* illustrates the externally generated injection pulse train $t_i$; FIG. 3*c* exhibits the potential at the collector of the output transistor T3 as a function of time; the curve 3*d* is the voltage at the output point P6 of the flip-flop 6; and the curve 3*e* illustrates the voltage at the output P5 of the two-point controller 4. The combination of events as depicted determines the valve current which is shown in FIG. 3*b*. At the instant of arrival of the front edge of the injection pulse $t_i$, the output transistor T3 conducts and supplies the valves with the battery voltage $U_o$ reduced by the saturation voltage across the transistor. At the same time, the output voltage at the point P6 of the flip-flop 6 changes according to the curve shown in FIG. 3*d* to negative values, thereby shifting the set-point to the desired value in the initial and rising phase for the current. The output P5 of the two-point controller 4 is also at zero or negative potentials at the beginning of the $t_i$ pulse. According to FIG. 3*b*, the current $I_V$ increases in accordance with an exponential function and approaches the peak value $I_1$ which is subject to limitation. As soon as the current reaches the value $I_1$ at time $t_1$, the two-point controller switches according to FIG. 3*e* and blocks the output transistor T3 so that the valve current $I_V$ decays in accordance with the prevailing time constants until it reaches the lower threshold value $I_2$ at a time $t_2$. At this point, the controller again switches over so that the output transistor continuously switches back and forth within a band of width $I_H$ and under the control of the two-point controller so that the valve current fluctuates between the two limiting values $I_3$ and $I_2$.

At the time $t_3$, the $t_i$ pulse and the driver circuit 2 turn the output transistor T3 off finally so that the valve current $I_V$ drops to the value zero. The output P5 of the controller returns to and stays at negative potential because the valve current $I_V$ has fallen below the lower limit $I_2$. As a consequence, the collapse of the magnetic fields generated by the coils of the valves causes a voltage increase at the collector of the output transistor T3 which is labeled $P_X$ in FIG. 3*c*. This voltage peak is received by the diode D2 via the quenching element R9 and is kept within harmless limits.

The circuit of the bistable flip-flop 6 which causes the set-point switching for the initial and rising phase of the valve current $I_V$ will now be explained in detail. The flip-flop 6 includes a differential amplifier B2, the inverting input of which is held at a fixed medium constant voltage which is provided by the junction of resistors R27 and R28 which are connected between the voltage supply lines of the system. Preferably, this fixed voltage may be adjusted to half way between the two battery voltages, i.e., $U_o/2$. The operational amplifier B2 obtains a stable state by connecting the output P6 to the non-inverting input through a resistor R29. At the same time, this input is connected to the junction of resistors R24 and R25 which constitute a voltage divider connected between the positive and negative supply lines, thereby producing a pronounced joint coupling so that the voltage at the non-inverting input is definitely higher than the voltage at the inverting input and this state becomes stable. By causing a short-term pull-down of the input voltage at the non-inverting input below that at the inverting input, the flip-flop 6 can be caused to change its output voltage at the point P6 to the negative side. In a corresponding manner, the output voltage may be changed to the positive potential. The input injection pulse $t_i$ flows through the line 20 and the capacitor C2 as well as through a diode D9 to the inverting input of the operational amplifier B2. The pulse is differentiated by the capacitor C2 and the grounded resistor R26 and the positive spike pulls the potential at the inverting input temporarily to positive values so that the flip-flop switches over to negative output values. The adjustment of the set-point takes place via the diode D10, as already explained.

As soon as the valve current $I_V$ then reaches the increased set-point value $I_1$, the output P5 of the controller 4 switches to positive potential and the voltage at the non-inverting input of the operational amplifier B2 is so increased through the series connection of the diode D8 and the resistor R23 that the flip-flop 6 returns to its initial state in which its output voltage is positive. The temporary increase of the set-point value via the diode D10 is then made ineffective.

Figure 4:
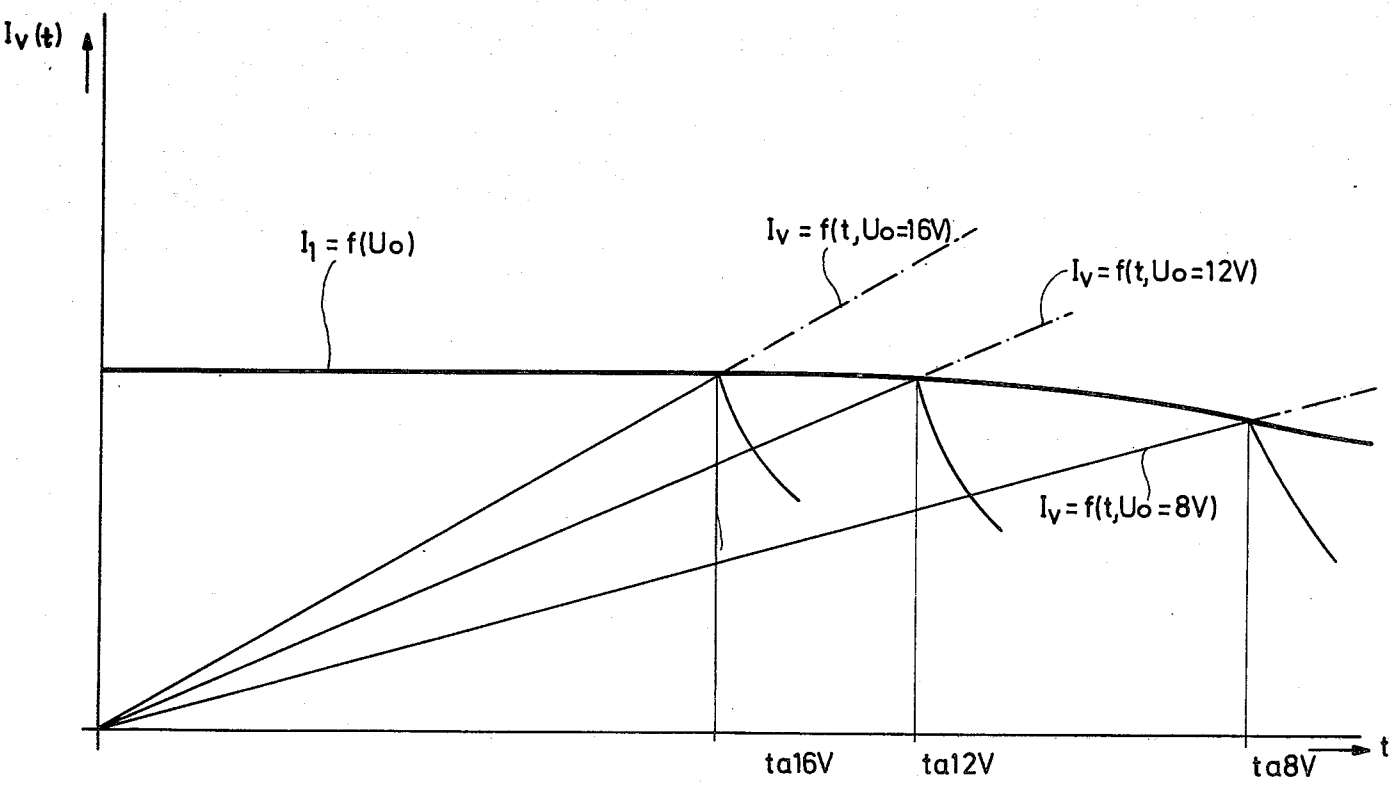
FIG. 4 is a set of curves illustrating a first possibility of configuration for the initial valve current.
Figure 5:
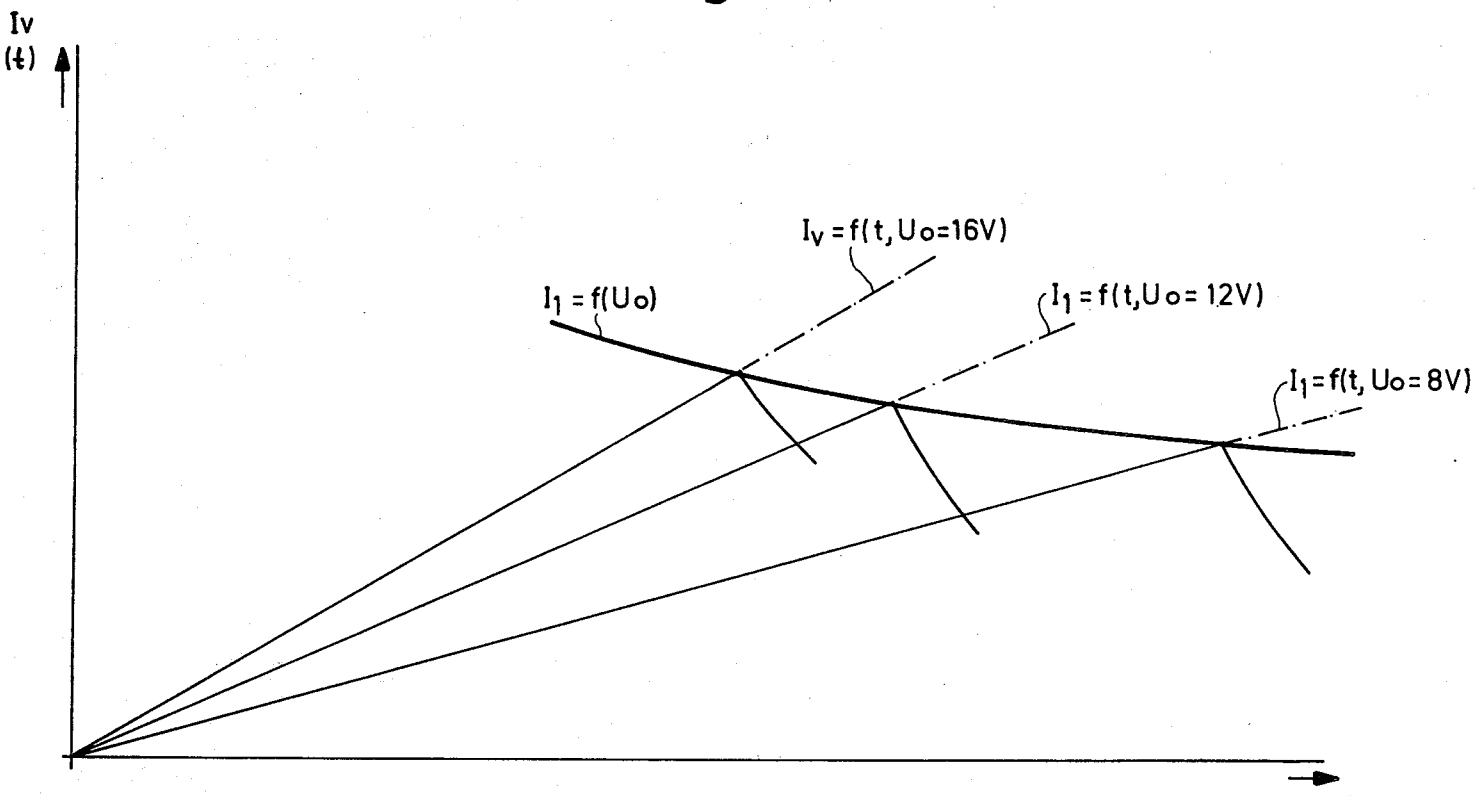
FIG. 5 is a set of curves showing a second possibility for configuring the initial phase of the valve current.
Figure 6:
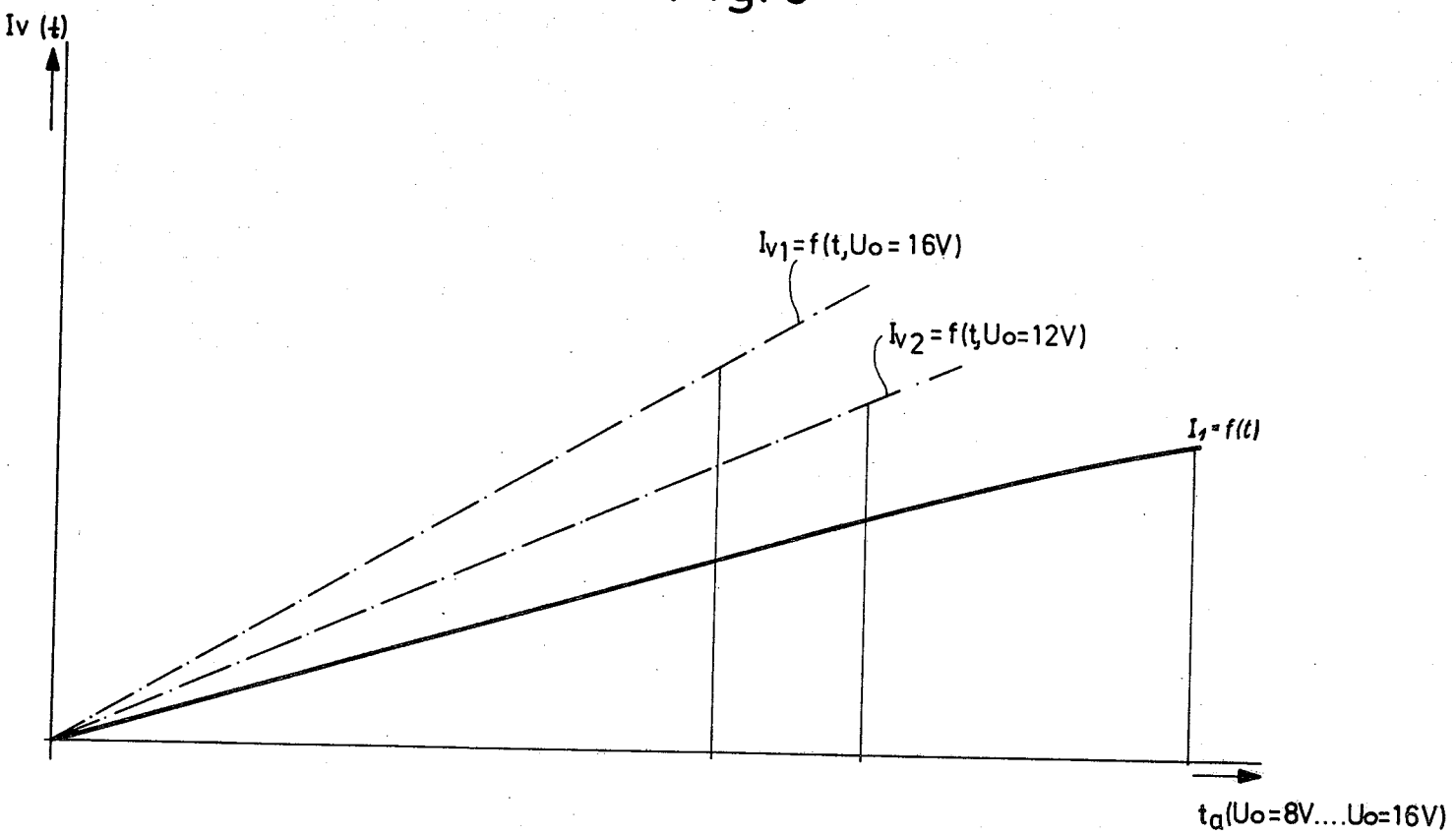
FIG. 6 is an illustration of a third possibility of the initial phase of the valve current.
Figure 7:
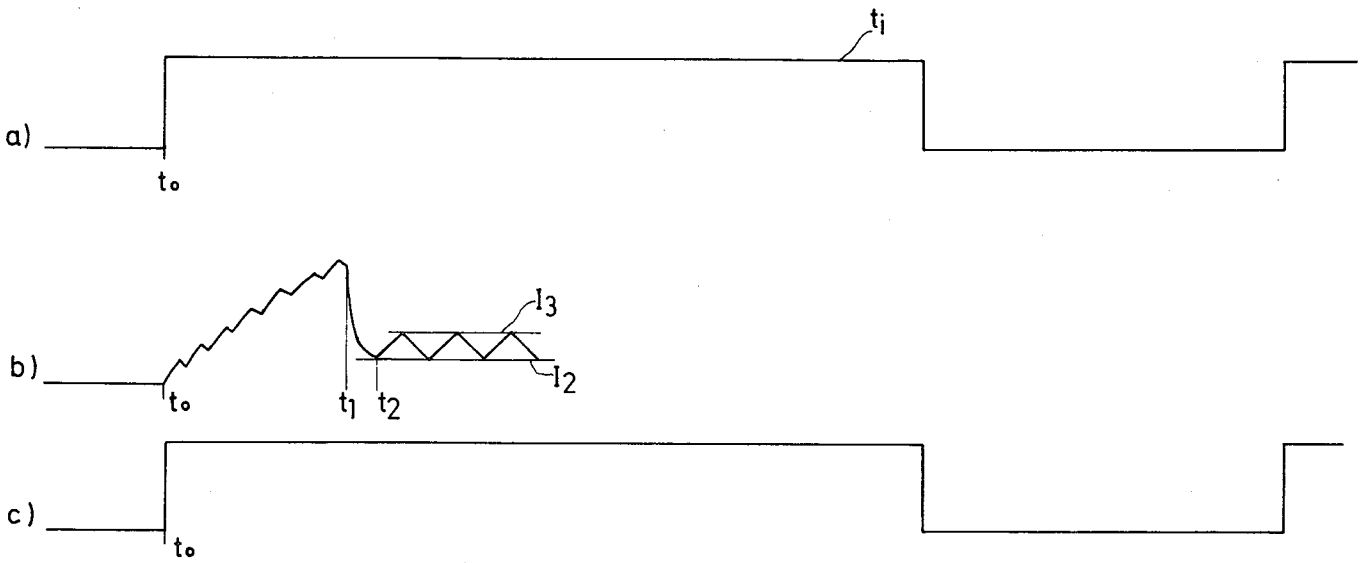
FIG. 7 is a pulse timing diagram showing the voltages and currents in a further exemplary embodiment of a control circuit where the initial phase of the valve current is controlled.

FIGS. 4 through 6 illustrate the behavior of the valve current $I_V$ as a function of time in various possibilities for the magnitudes of the set-point and set-point switching. In particular, FIG. 4 shows that the initial increase of the valve current is different for different voltages. In the upper battery voltage region, the set-point for the current $I_1$ in the initial phase as determined by the elements D10, R14 and R15 is constant, i.e., in this region the current is limited to the value $I_1$ independently of the battery voltage $U_0$. Three different curves are shown for the initial phase of the valve current, namely at a battery voltage or supply voltage of $U_0=16$ V, $U_0=12$ V and $U_0=8$ V. At the lower battery voltage, as illustrated in FIG. 4, the increase of the current in the initial phase gradually becomes less steep as a function of time because, for the same time constant, the final value is lower. Beginning with a certain lower voltage, the valve is actuated before the limited maximum current $I_1$ is ever reached. In FIG. 4, the heavy lines illustrate the function $I_1=f(U_0)$. Thus the set point for the current $I_1$ is suitably so chosen that the current $I_1$ at a normal battery voltage, for example $U_0=14$ V, is reached at the moment that the values are actuated. If the battery voltage is higher, it will be limited to this constant value, whereas, if the battery voltage is lower, the current is limited to smaller currents in such a way that the limitation occurs only at a current which is reached after the valves are actuated so that it is possible always to maintain the shortest possible actuation time $t_a$. The abscissa of FIG. 4 illustrates the actuation times for the various battery voltages, i.e., $t_{a16\ V}$, $t_{a12\ V}$, $t_{a8\ V}$.

In a further exemplary embodiment, the valve current $I_V$ is limited only after the valve or the valves have been actuated for any and all operational battery voltages $U_0$. As shown in FIG. 2 in dashed lines, this embodiment provides a resistor $R_X$ connected in series with the diode D5. In that case, the voltage across the resistor $R_X$ is added to the voltages across the diodes D3 and D5 so that the limitation of the potential shift of the set-point by the flip-flop 6 is decreased. This permits a higher limited current $I_1$ for the initial current rise so that it is possible to maintain the shortest possible actuation times even in the upper battery voltage region and the maximum current $I_1$ is not limited to a constant value for all upper battery voltages. The curves which illustrate the current for the initial phase of the valve current for the present exemplary embodiment and for three different battery voltages are shown in FIG. 5.

In yet another variant of the circuit, it may be provided that the set-point, i.e., the voltage at the point P3 of the circuit of FIG. 2, and thus the limitation of the valve current in the initial rising phase, is a continuous function of time. For this purpose, the two-point controller 4 may be so influenced that the initial rising phase of the valve current follows a curve which corresponds to the normal behavior at the lowest commonly occurring battery voltage. As already mentioned, this is done by generating the set-point value as a function of time in the form of a limited exponential function. This curve is shown in FIG. 6 which also illustrates the hypothetical rising curves of the valve current in dash-dotted lines which would be obtained if the valve current were not limited. These curves are shown in FIG. 6 as $I_{V1}$ and $I_{V2}$. The curve which is decisive for all battery voltages is labeled $I_1$ and is shown as a heavy continuous line and provides the same valve actuation time for all battery voltages. This may be very desirable because it makes it possible to always be able to count on a battery-independent time permitting uniform compensation if required. The curve of FIG. 7*a* again illustrates the injection pulse train $t_i$, whereas the curve of FIG. 7*b* now shows the valve current which is seen to be controlled even in its initial rising phase because, due to the continuously changing set-point value, the two-point controller 4 already engages the output circuit 3 during the initial increasing current phase. FIG. 7*c* illustrates the function of the free-running circuit 12 which is required to be operative at the time $t_0$.

Both the disengagement as well as the actuation of the valve are independent of voltage in advantageous manner so that any compensation of the valve actuation time may dispense with the normally required voltage correction circuitry and it is required only to accept an additional time which is itself independent of voltage and that only if the actuation time $t_a$ is not equal to the disactuation time. These two times may be made equal by appropriate choice of the quenching element, i.e., the actuation time $t_a$ is equal to the disactuation time $t_{ab}$=-const., thus requiring neither voltage correction nor the addition of a constant time delay.

The quenching member is required because the limited voltage capability of the output transistor T3 does not permit the unquenched switching of the electromagnetic valves 1. During the duration of the injection pulse $t_i$, the free-running circuit is turned on and results in a lowered control loop frequency and lowered power losses because the decay of the current takes place over the low impedance free-running path with the high time constant $t_{ab}=L/R$ free-running.

In the exemplary embodiment of FIG. 2, the measuring resistance R10, which determines the actual value of the valve current, is located on the side of the positive line 16 and thus measures the current both during free-running and quenching phase when the output transistor T3 is turned off; thus it does not exhibit a common mode signal which would impede its use.

Figure 8:
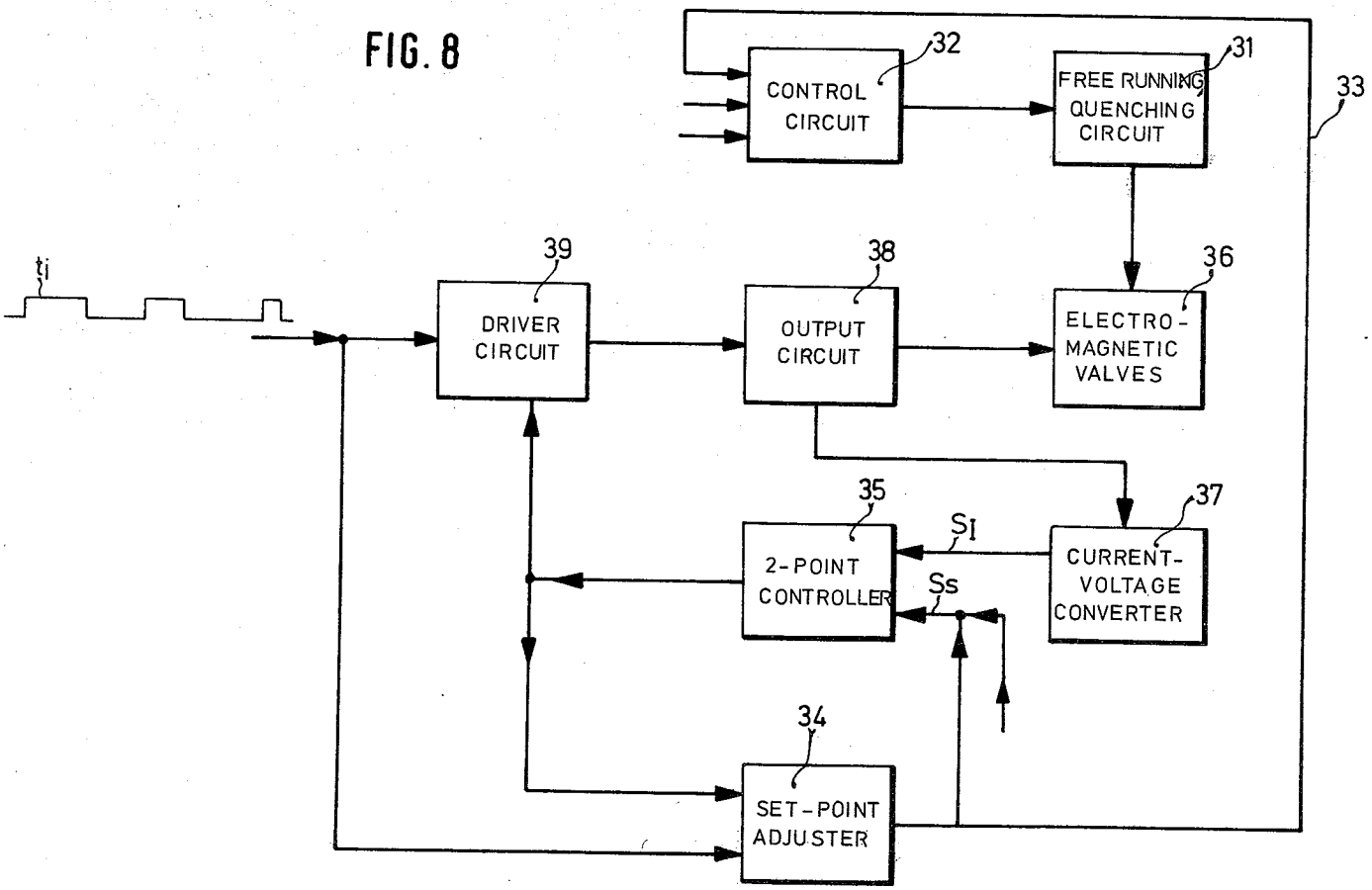
FIG. 8 is the schematic block diagram of a second embodiment of the control circuit for electromagnetic switching systems.

A second major embodiment of the invention is illustrated in the block circuit diagram of FIG. 8, which is similar to the block circuit diagram of FIG. 1, but with the main difference that the free-running control 32 which controls the free-running and quenching circuit 31 is not immediately affected by the control pulse $t_i$ of the fuel injection system. Instead, this signal is carried through a line 33 from the output of the set-point switching circuit 34. A second substantial difference with respect to the first embodiment is to be seen in that the control variable of the two-point controller 35 is not directly taken to be the current in the valves 36. Instead, the control variable is the current in the output transistor T11 which is measured with a suitable transducer circuit 37 which, in the simplest case, is merely a measuring resistor R41. In the diagram of FIG. 8, the output circuit is designated with the numeral 38 while a prior driver and logic circuit is labeled 39. The detailed circuitry of the various blocks in FIG. 8 is given in FIG. 9 in which the major components are surrounded by dashed lines and carry the same reference numerals as they do in FIG. 8. Basically, the current controlled output circuit shown in FIG. 9 has an input logic and driver circuit 39 with a contact P11 which receives the fuel injection control pulses $t_i$ which are produced externally by a fuel injection system which is not further discussed. The duration of each of the pulses substantially depends on the air flow rate aspirated by the engine and on the prevailing engine rpm. In the exemplary embodiment of FIG. 9, the fuel injection control pulses finally actuate injection valves 36 which are electromagnetic valves in the engine and which feed the proper amount of fuel to the engine on the basis of the duration of the injection pulses $t_i$.

In the circuit of the first embodiment according to FIG. 2, there is provided a driver circuit for controlling the output transistor and the output of the two-point controller determines the switching condition of the output transistor. In a somewhat simplified circuit, embodied in FIG. 9, the output transistor T11 may be controlled directly via a resistor R42 by the potential at a circuit point P11' so that the driver circuit 39 may be dispensed with. In that case, the output P12 of the two-point controller 35 is conducted through the line L20 to the base of the output transistor T11 and, in a suitable manner through the series connection of resistors R43, R44, to the base of a blocking transistor T12, the collector of which is connected to the base of T11 via the line L20. Whenever the two-point controller measures a high valve current, either by means of a measuring resistor R10 such as in FIG. 2 or a measuring resistor R41 as in the present embodiment, the transistor T12 switches to conduction and the base of the output transistor T11 is blocked. It will be appreciated that the operation of the two-point controller 35 does not necessarily require a set-point switching circuit because it is possible to obtain a controlled valve current through the output circuit on the basis of the behavior of the two-point controller 35 of the present exemplary embodiment or of that of the two-point controller 4 of the first exemplary embodiment. However, in that case, the absence of the set-point switching circuit makes it impossible to lower the valve current to the predetermined maintenance current although, after the current has reached its maximum, the controller blocks the output transistor T11 and turns it back on at a later time.

Inasmuch as the basic circuits and operation of the current-controlled output circuit have already been discussed with respect to the first embodiment, the various circuits of the second embodiment will be discussed only in connection with their operation.

The initial driver and logic circuit 39 in the present exemplary embodiment is formed by two inverter circuits, one of which is an operational amplifier B6 acting as a comparator and the second of which is a transistor T13. When the positive $t_i$ injection pulse is present at the anode of the diode D21 which is connected to the inverting input of the operational amplifier B6, the comparator B6 switches its output potential to zero because the inverting input is at a higher potential than the non-inverting input which receives its fixed voltage via a line L21. The inverting input of the comparator B6 has a multiple branched input including, respectively, diodes D21, D22 and D23 which are coupled to the input over a voltage divider consisting of resistors R45 and R46. In this manner, it is possible to have a relatively high input impedance for other fuel control pulses coming from different elements of the fuel injection system, for example from a multiplying circuit, a cold starting control circuit, an accelerating enrichment circuit, and no additional drive power is required at this point. When the comparator output B6 switches to the lower potential at the receipt of a $t_i$ pulse, the subsequent transistor T13 can no longer conduct and blocks. The output transistor T11 now receives base current through the resistor R48 and the resistor R42 and becomes conducting. The base current is conducted to ground via resistor R49. A significant aspect of the present exemplary embodiment is that the emitter of the transistor T11 is not directly connected to ground or to the negative supply line L22 but rather to the above-mentioned measuring resistor R41 and the voltage across the resistor R41 is sensed via a further resistor R50 and over the line L23 by the non-inverting input of a further comparator B7 which is a major component of the two-point controller 35. The measuring resistor R41 in the emitter circuit of the output transistor T11 converts the valve current to be measured into a voltage which the controller 35 may use. While the controller 35 now also measures the base current of the output transistor T11, the voltage is very close to ground or zero and is directly related to the valve current. This voltage signal on the measuring resistor is obtained during the time that the output transistor T11 is turned on. As will be discussed in greater detail below, the conversion of the valve current makes high requirements on the ability of the subsequent two-point controller 35 because, when the valve current is turned off, the latter immediately senses a current which is too small, but this type of conversion relieves the measuring resistor of high power and thus has an advantageous effect on its size and on stability. The valves 36 are connected in the collector circuit of the output transistor T11 and, in this exemplary embodiment, one of their electrodes is connected to the positive supply voltage, i.e., the vehicle battery voltage, which is designated $+U_V$. This manner of connection reduces the number of required connectors.

Figure 9:
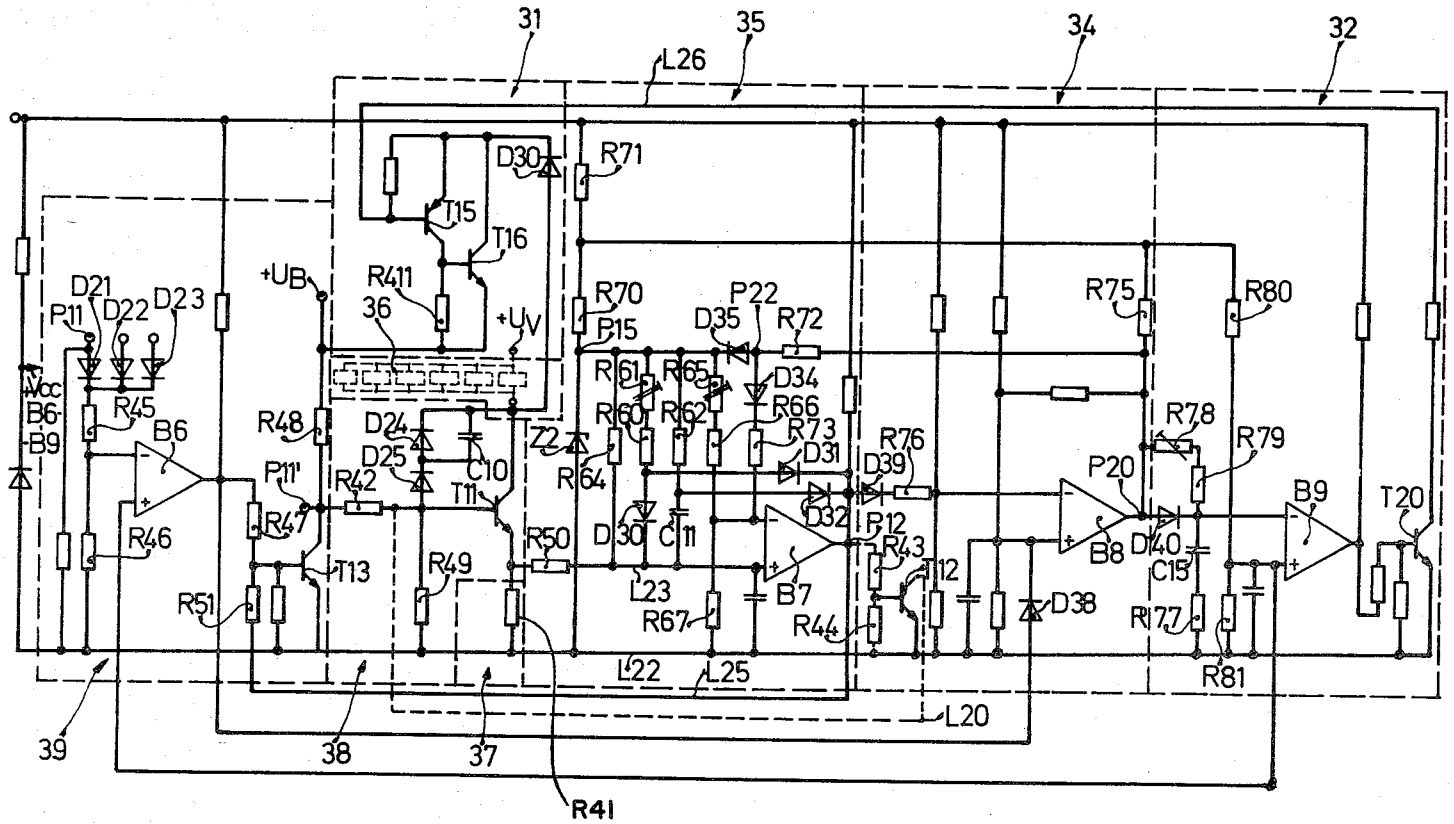
FIG. 9 is a detailed circuit diagram.

A significant aspect of the operation of the present exemplary embodiment is the function of the free-running circuit 31 and the quenching circuit. The free-running circuit 31 is so controlled that the rising current I1 flowing through the valves 36 and the output transistor T11 is switched in quenched manner to the maintenance current $I_H$ while the free-running circuit is blocked. This permits a very precise controllability of the output transistor T11 down to very short values of the pulse $t_i$. On the other hand, the quenching circuit is so constructed as to produce a significant reduction of the power peak during quenching without adversely affecting the control behavior in the free-running phase. The function of the quenching circuit in the present exemplary embodiment according to FIG. 9 is performed substantially by the series connection of the Zener diodes D24, D25 between the collector and the base of the output transistor T11. In a further advantageous embodiment, a capacitor C10 is connected in parallel to the Zener diode D24. In a condition wherein the $t_i$ control pulse is present and the output transistor T11 conducts, if the valve current $I_V$ is greater than the adjusted set-point, the output P12 of the two-point controller goes to high potential and the second stage of the input logic circuit 39, i.e., the transistor T13, becomes conducting, thereby blocking the output transistor T11. As will be explained in more detail with the aid of the diagrams of FIGS. 10*a* to 10*h*, during this first blockage of the output transistor T11 which takes place so as to reduce the valve current from a relatively high initial value I1 to a lower value I4 or to the maintenance value $I_H$, the free-running circuit 31 is turned off so that the valve current can very rapidly drop in quenched manner to its maintenance value. The inductive turn-off peak which occurs during the turn-off is limited by the diodes D24 and D25 to a value $U_K<(U_{D24}+U_{D25}+U_{BET11})$, thereby producing an effective protection of the output transistor T11. The switch-off voltage cannot exceed the limiting value because the diodes D24 and D25 would then become conducting as would the transistor T11 due to the connection with its base and that would reduce the potential at the collector of the output transistor T11. During a quenched shut-off, this potential rises, thanks to the self-induction of the electromagnetic valves, to a voltage which is higher than the battery voltage. Thus, during the quenched shut-off, the collector potential of the output transistor rises to a relatively high value, causing a very rapid decay of the current in the valves 36. The base drain resistor R49 receives the collector-base current of the transistor T11 and, by being very close to it spatially, it suppresses oscillations of this transistor during quenched shut-off, i.e., during a so-called clamping operation by means of the diodes D24, D25.

Figure 10:
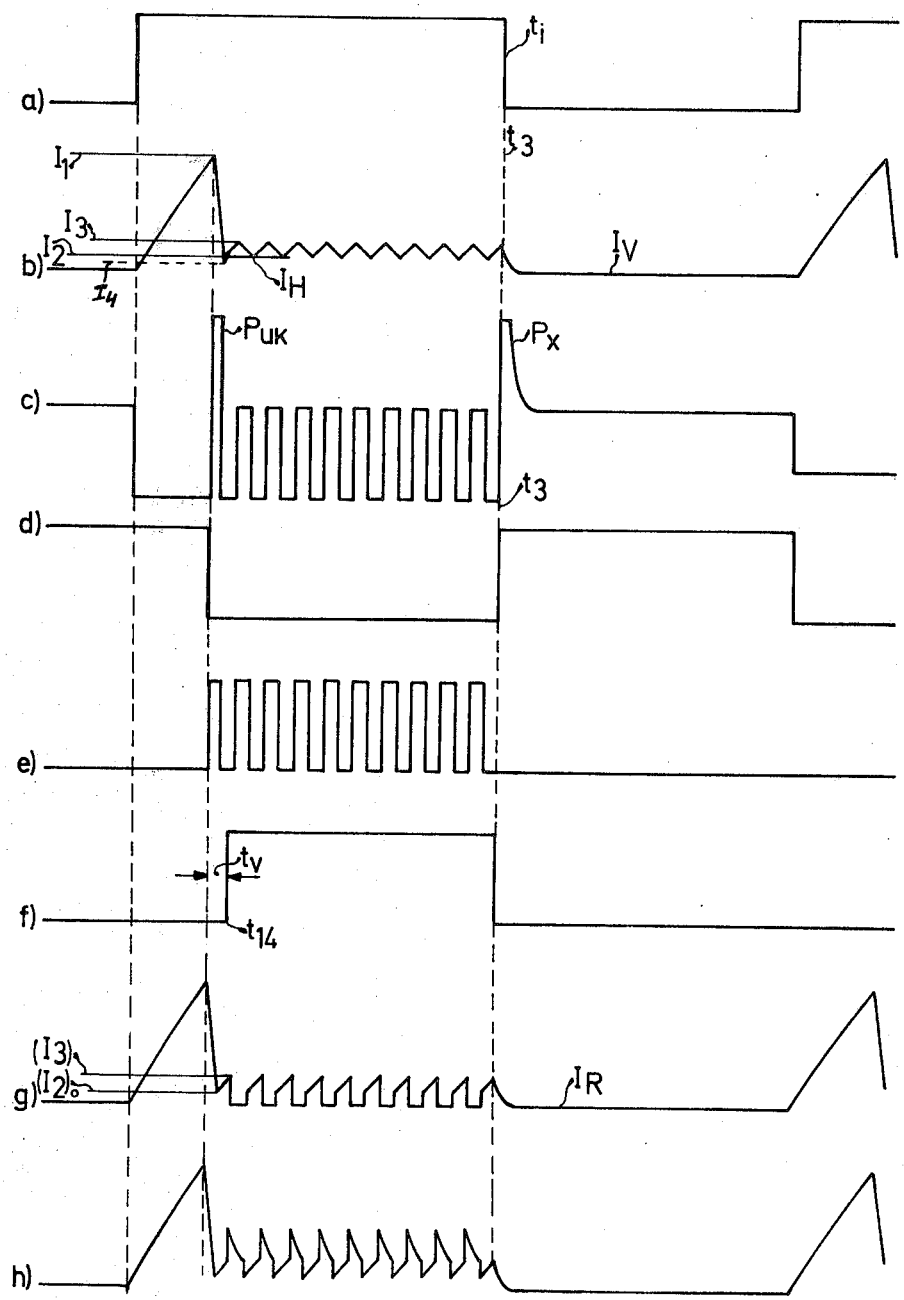
FIG. 10 is a set of timing diagrams of voltages and currents at various points of the current control circuit of FIG. 9.

The various curves of FIG. 10 serve to illustrate the operation. At the onset of the $t_i$ pulse, according to FIG. 10*a*, the output transistor switches as in FIG. 10*c* which shows the collector voltage of the transistor T11. Thus the valve current rises according to the curve shown in FIG. 10*b*, i.e., an exponential function, until it reaches the value I1 required for a reliable actuation of the valves 36. This value of the current is the prevailing set-point at the inverting input of the two-point controller. The set-point for the valve current I1 is determined by the output of a set-point switching circuit, the behavior of which is illustrated in FIG. 10*d*. The value of the setpoint which is placed at the inverting input of the comparator B7 is shown in the curves of FIG. 10*h*. As soon as the maximum valve current I1 of FIG. 10*b* has been reached, the output at the point P12 of the controller illustrated in FIG. 10*e* goes high and the output transistor T11 is turned off via the line L25. FIG. 10*c* illustrates the collector potential of the output transistor T11. While the free-running circuit 31 is still out of operation, the quenched current turn-off leads to the voltage peak $P_{UK}$ at the collector of the transistor T11 (see FIG. 10*c*). At the same time, the set-point switching circuit 14 switches back as shown in FIG. 10*d*. As already mentioned, the onset of the free-running and the turn-on of the free-running circuit 31 is actuated by the control stage 32 at a time which is delayed by the period $t_v$ (see curve 10*f*). Thus, the valve current I1 rapidly decays to the value I2 in quenched manner so that the above-mentioned turn-off voltage peak is generated.

In an actual experiment, the quenched decay of the current to the maintenance current took place within 100 microseconds. If this relatively short period of time is compared with a relatively slow period of decay in the exemplary embodiment of FIG. 10 (the time between $t_1$ and $t_2$) it will be recognized that the quenched shut-off with acceptance of a high turn-off peak permits the processing of very short $t_i$ injection pulses while maintaining a linear relationship between the fuel quantity and the period of the injection pulse because, when the $t_i$ pulse is terminated, the instantaneous valve current begins its decay; if a relatively short $t_i$ pulse is present which falls within the normal rise and decay times of the output circuit, a linear relationship between fuel and control pulse could not be achieved. This is illustrated more clearly in FIG. 11 where it will be seen that the fuel quantity Q delivered by the injection valves ideally depends on the duration of the injection pulse $t_i$ as a straight line and this may be achieved with the aid of the present invention if the valve current has been reduced to maintenance current during very short pulses $t_i$.

Figure 11:
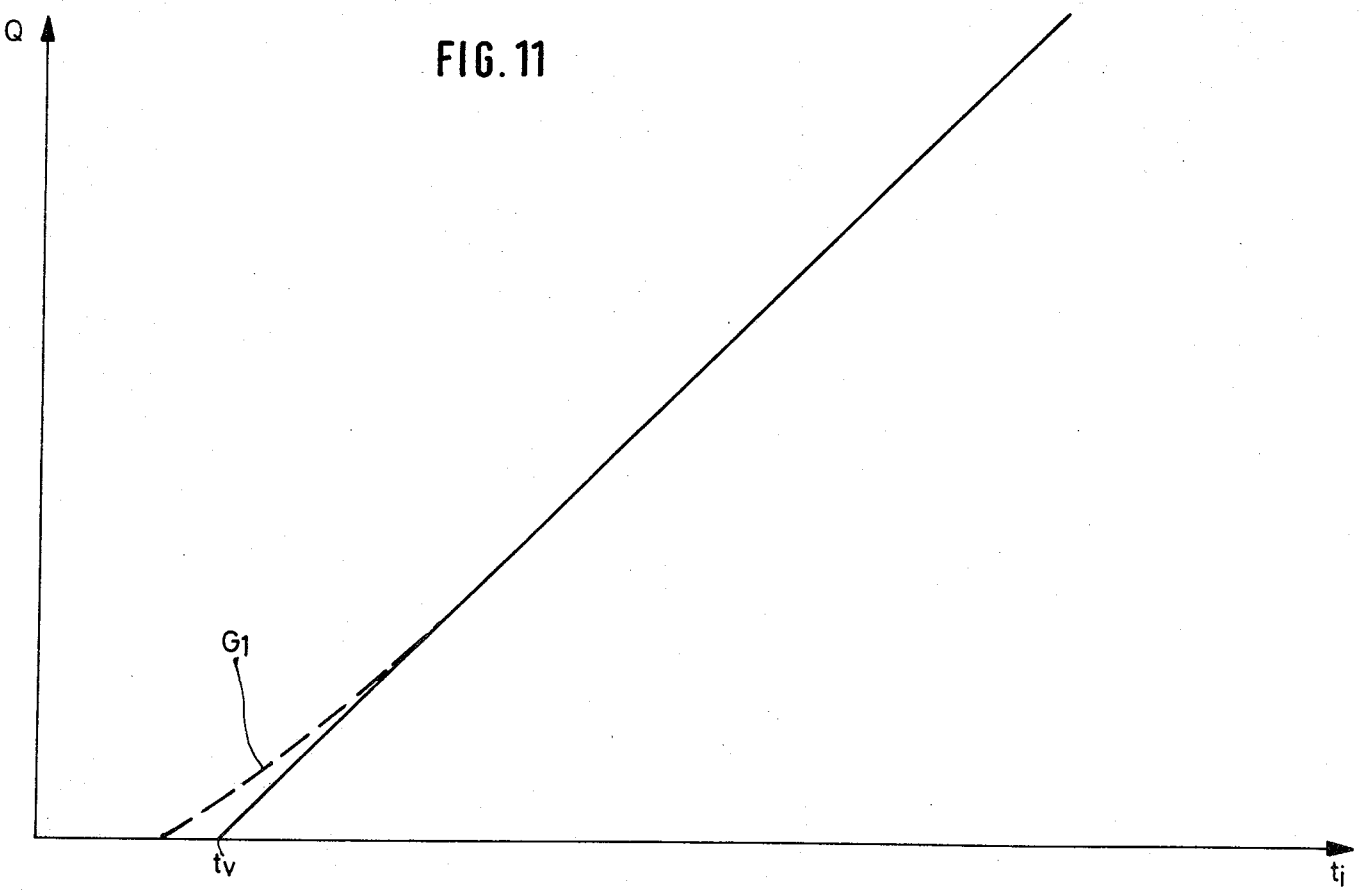
FIG. 11 is a curve showing the output fuel quantity as a function of injection pulse duration.

The dashed portion labeled G1 in FIG. 11 represents a non-linear behavior of the fuel quantity due to excessive valve current. The ideal straight line cuts the abscissa at the point $t_v$, i.e., at the time of delay prior to the turn-on of the free-running circuit as will be explained below. The very rapid decay of the valve current from the value I1 to a lower value I4 and finally the value I2 prevents the relatively long decay times which would take place if the free-running circuit 31 were turned on. As already explained, this would result in non-linearities of the fuel as a function of control pulse period because the output circuit could be affected only after relatively long times for the pulse $t_i$.

The quenched decay of valve current from the value I1 to the value I4 ($I_H$) is followed by a phase in which the switching condition of the output transistor T11 is determined by the two-point controller. Up to the time $t_3$, there is a regular increase in decay of the valve current within a very relatively narrow band and during the decay, the valve current flows through the activated free-running circuit 31. A favorable construction of the quenching circuit in this embodiment will now be discussed. The disposition of the two Zener diodes D24 and D25, one of which is shunted by the capacitor C10, has the purpose to limit the power peak of the output transistor T11 during the so-called clamping operation of the quenching circuit. This is explained more precisely with the aid of FIGS. 12*a* to 12*f*. During the transition into the clamping operation, i.e., the quenching function after reaching the predetermined maximum valve current I1 at the time t10 in FIG. 12*b*, the collector voltage of the output transistor T11 immediately jumps to the above-mentioned clamping voltage $U_K$ and the power in the output transistor T11 is that shown in FIG. 5*d*. When the capacitor C10 is present, the collector voltage of the transistor T11 varies shown in FIG. 5*e*, initially to the value $$U_{K1}=(U_{D25}+U_{BET11})$$

and then increases due to the recharging of the capacitor C10 approximately linearly to a final value $$U_{K2}=(U_{D25}+U_{D24}+U_{BET11}).$$

In this manner the power peak of the transistor T11 is reduced approximately by one-half, i.e., $$\text{from } \hat{N}_1 \text{ to } \hat{N}_2 \approx \hat{N}_1/2.$$

Figure 12:
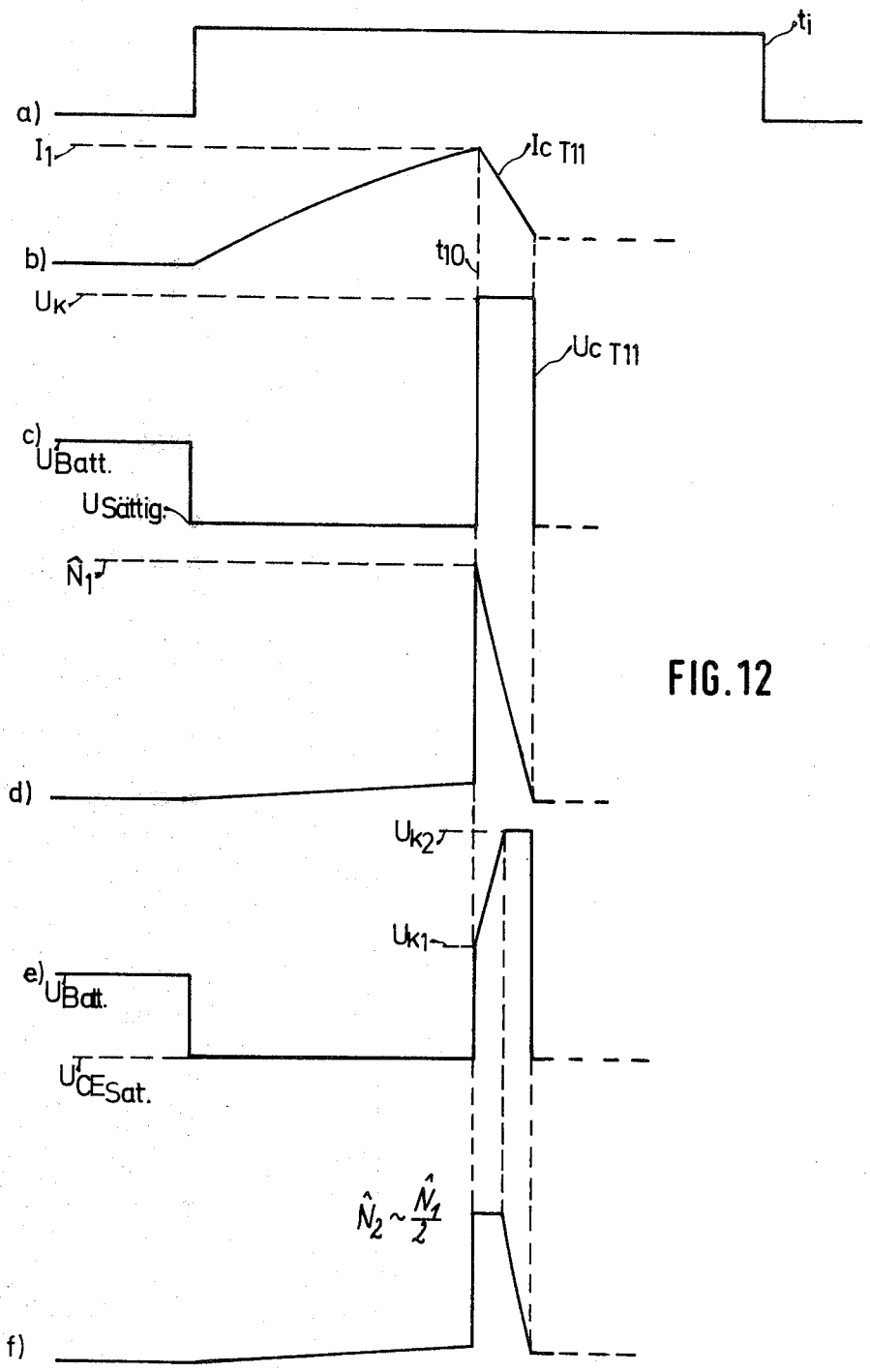
FIG. 12 is a set of curves illustrating the operation of a special quenching circuit.

Due to the prevailing small clamping times (quenching function) which are, as already cited, in the neighborhood of 100 microseconds after the power peak, the pulse loading of the transistor T11 is substantially reduced as is illustrated in FIG. 12*f*. FIG. 12*e* shows the varying collector voltage of the transistor T11 during clamping operation.

During the current control operation, and when the free-running circuit is actuated, the collector potential of the transistor T11 rises to only approximately 2 volts above the battery voltage $U_B$. If the Zener diode potential of the diode D25 is so chosen that $U_{D25}>(+U_B+2$ V) then the quenching circuit has no effect in the controlled phase and for an actuated free-running circuit, because the Zener Diode D25 does not respond to the low voltage which occurs for an actuated free-running circuit. It therefore also is useful to provide the Zener diode D25 for the quenching member function, because a clamping circuit which consists only of a Zener diode and a parallel capacitor can cause a limitation of the pulse peak but, because of the presence of the capacitor, this device also becomes effective during the control phase of the operation so that the switching times and therefore the switching losses increase due to the opposite coupling.

The free-running circuit is composed in the manner already described with respect to the first embodiment; there are provided two transistors T15 and T16 which gradually conduct away the valve current to the positive battery potential via the diode D30 and the line L26 so that, for example, the rise and fall times for the valve current in the controlled phase (the fluctuation band of the maintenance current $I_H$) may be obtained (see FIG. 10*b*). The free-running circuit consists of a combination of a PNP transistor T15, and an NPN transistor T16 with an NPN Darlington transistor T11 used as as switching transistor. It has already been mentioned that, in this embodiment, the current-controlled ouput circuit provides to the subsequent two-point controller only a sensor signal for evaluating the valve current so that a normal two-point controller, which is a comparator having voltage hysteresis, cannot be used. When the valve current is so large as to reach the switching point of the comparator B7, the latter switches the output transistor T11 off via transistor T13 and thus at the same time removes its own actual value signal. Without special circuitry, which consists in the present exemplary embodiment of resistors R60, R61 and R62, the capacitor C11 and diodes D30, D31 and D32, a stable operation of the two-point controller is not possible because, when the actual value signal vanishes, the controller immediately sees a current which it regards as being too small and then would re-connect the transistor T11, thereby causing the controller to operate at high frequency. By special circuitry within the controller, there is obtained a so-called timed hysteresis which permits a satisfactory switching behavior of the controller without oscillations.

Figure 13:
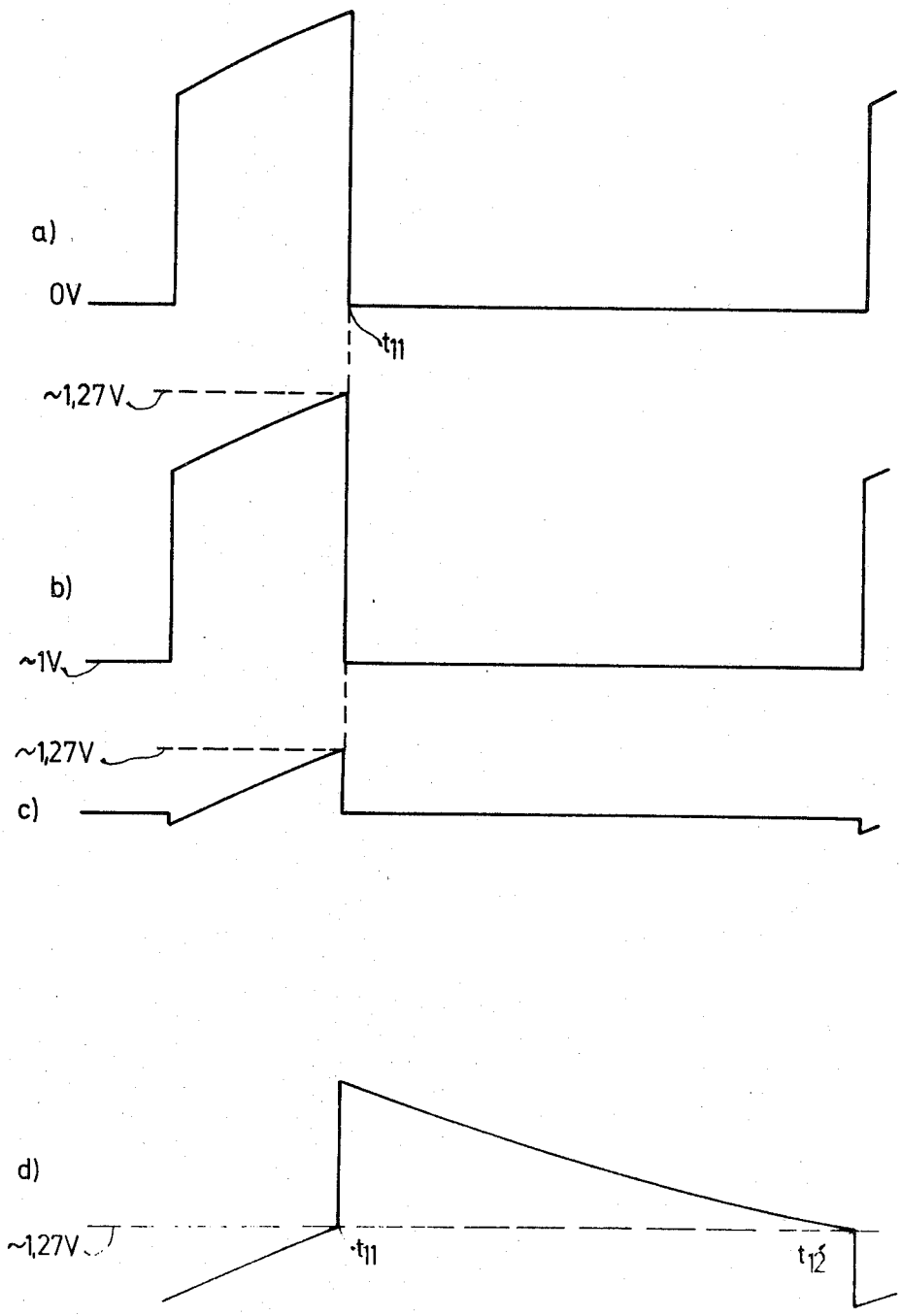
FIG. 13 is a set of timing diagrams showing the voltages at the inputs of the two-point controller used for controlling the output circuit.

The sensed actual value signal $U_{R41}$ obtained from the measuring resistor is placed in a more useable and more positive region of potential by means of the voltage divider circuit consisting of resistors R50 and R64 which are connected to the point P15 at a voltage stabilized through the Zener diode Z2 and this signal is fed to the non-inverting input of the controller. The inverting input of the controller (set-point input) receives the set-point potential provided by the voltage divider composed of the resistors R65, R66 and R67. As long as the actual value placed on the non-inverting input is smaller than that at the inverting input, the controller output P12 is at low or ground potential. Inasmuch as both diodes D31 and D32 at the output of the comparator B7 are then conducting, the diode D405 blocks and the capacitor C11 can exchange charge. As soon as the actual value exceeds the set-point value, the output P12 of the comparator B7 goes to high potential and thus cuts out the output transistor T11. In order that the actual value signal, which is formed at the input of the comparator B7, does not drop below the switching threshold, the resistor R50 receives a fixed magnitude current via the conducting diode D30 and the resistors R61 and R60 which leads to an increase of the potential fed to the non-inverting input up to approximately 10 percent below the switching point. When the comparator output signal had switched, the diode D32 as well as the diode D31 had blocked and an exponentially decaying current was placed in the resistor R50 by the capacitor C11 and the resistor R62. This causes the actual value voltage to rise in the positive direction until it exceeds the switching threshold and the controller is able to maintain a high potential at its output P12 until the supplementary current which decays through the resistor R62 and the capacitor C11 has dropped until the switching point is reached again. (See curves of FIG. 10*h* and the detailed illustration of FIG. 13 which will be discussed below). By comparing the curves of FIGS. 10*g* and 10*h* it will be seen that the current $I_R$ in the measuring resistor R41 is in approximately the opposite direction to the potential which prevails at the actual value input (non-inverting input) of the comparator B7 in the control phase which is determined by the actuation of the free running circuit. By comparing the curves 10*b* and 10*g* it will also be seen that the current in the measuring resistor $I_R$ as well as the valve current $I_V$ has a first initial rising phase and then abruptly falls to zero, whereas the valve current $I_V$ gradually reaches a lower magnitude I2 which is due to the functioning of the free-running circuit 31 which takes over the control of the valve current in this phase of the operation. Subsequently, the measured valve current $I_R$ at first returns to a new initial value related to the valve current I2 and then rises together with the latter until it reaches the maximum value I3 (in the controlled phase). FIG. 13 shows in detail how the transduced or simulated actual voltage at the non-inverting input of the comparator B7 is formed. FIG. 13*h* shows the measuring voltage $U_R$ at the measuring resistor R41 which is seen to follow the measuring current $I_R$ in FIG. 10*g*. FIG. 13 also shows the absolute voltages obtained in the present exemplary embodiment. FIG. 13*b* shows the voltage of the pulse from the measuring resistor which occurs at the input of the comparator B7 after the potential is increased by means of R64 and R50. FIG. 10*c* shows the pulse voltage at the input of the comparator B7 as it occurs due to the pulse voltage in FIG. 13*b* and on the basis of the disposition of resistors R60, R61 and the diode D30. Finally, FIG. 13*d* shows the resulting pulse voltage at the positive input of B7 as obtained from the measured voltage $U_R$ and the elements R60, R61, D30, and R62 and C11. The set-point voltage at the other input of B7 is shown in dashed lines in FIG. 13*d*. The time during which the controller and its comparator B7 cuts out the output transistor T11 can be freely chosen and selected by suitable selection of the combinations R60/R61 and R66/R65 as well as R62/C11. In the present exemplary embodiment, the cut-out time is so chosen that the valve current drops in that time only by an amount equal to the width of the hysteresis band, i.e., approximately 10 percent.

Inasmuch as the maintenance current is independent of the battery voltage as already explained above, the width of the hysteresis band is constant as long as the dimensions of the free-running circuit and the controller cut-out time remain constant.

If the potential at the positive input drops below that at the negative input, the output P12 of the controller again returns to minus or zero potential. The diode D31 conducts and the diode D30 blocks so that the additional current from the resistors R61/R60 within the resistor R50 goes to zero. At the same time, the capacitor C11 is pulled to minus through the conducting diode D32 as is the potential fed to the positive input of B7. Because the controller output P12 is now low (zero potential, low voltage or logical zero) the output transistor T11 again conducts and the measuring resistor sees a signal corresponding to the valve current $I_V$.

The capacitor C11 recharges relatively rapidly at a time constant C11/R50 so that, after a short time required to reach a level signal, the actual value signal is obtained practically without delay at the positive input of the comparator. If the shortest turn-on time of the output transistor T11 is approximately 14 microseconds when the width of the hysteresis band for the valve maintenance current is 10 percent, then the time constant defined by C11/R50 is chosen to be approximately 2 microseconds. When the capacitance of C11 has been fixed, the turn-off time may be freely selected by the remaining degrees of freedom for the resistors R60/R61 and R62 in accordance with any requirements.

In order to obtain as satisfactory a function as possible for the controller with respect to temperature and voltage effects, the controller is driven from a stabilized voltage source which has a magnitude of approximately 5 volts in the present example and which is obtained by means of the Zener diode Z2 and the series resistors R70/R71. By comparing FIG. 13*d* with 13*a*, it will be seen that even when the measuring resistor voltage $U_R$ is turned off at the time t11, the actual value potential which is fed to the non-inverting input of the controller at first actually rises abruptly and then falls up to the time t12 at which time the set-point voltage is first exceeded in a downward direction and the comparator turns the output transistor T11 back on. The set-point switching circuit 34, which is connected behind the controller 35 and which consists primarily of the comparator B8, exerts a supplementary influence on the set-point potential at the inverting input of the two-point controller via the resistors R72/R73 and the diodes D34 and D35. The electrical function of the set-point switching circuit is as follows. Prior to the first switching of the comparator B7, the valve current set-point is high, i.e., the current flowing through R67 via R65 and R66 is high. This current is independent of battery voltage because the potential at the point P15 is independent. In addition, a current flowing through R67 is obtained from the path via resistors R72, R73 and the diode D34 and this current is battery voltage dependent. These two currents together cause a voltage drop across the resistor R67 which defines the set-point at the appropriate inverting input of the comparator B7. If the battery voltage now rises and thus increases the current through R72, R73 and D34, the potential at the point 22 also rises. The diode D35 limits this potential to a value which is exactly one diode conduction voltage-drop above the potential of point P15. This also limits the current through R73 and D34 and thus also the voltage drop across R67 which is the set-point value fed to the set-point input (negative input) of the comparator B7. After the first switching of the comparator B7, the comparator B8 also switches, points P20 and P22 go to low potential and block the diodes D34 and D35 and the voltage at the negative input of the comparator B7 is determined only by the voltage divider composed of resistors R65, R66 and R67.

In the present exemplary embodiment, the set-point switching circuit 34 is set immediately at the end of an injection pulse $t_i$ while, at the same time, the output transistor T11 is blocked in order to obtain the high set-point which corresponds to I1. Actually, the setting of the set-point switching circuit 34 needs to begin only at the onset of an injection pulse $t_i$ but the same function is obtained if this process is triggered already at the end of the previous $t_i$ pulse. Furthermore, this permits a very simple triggering for the set-point circuit setting and also permits a simplified free-running control, namely a delay circuit controlled by the set-point circuit. The output P20 of the comparator B7 has connected with it a resistor R75 which is at a point defined by the resistors R71/R70 so that the characteristic curve $I_1 = f(U_{battery})$ may be made dependent on the battery voltage in any desired manner.

Figure 14:
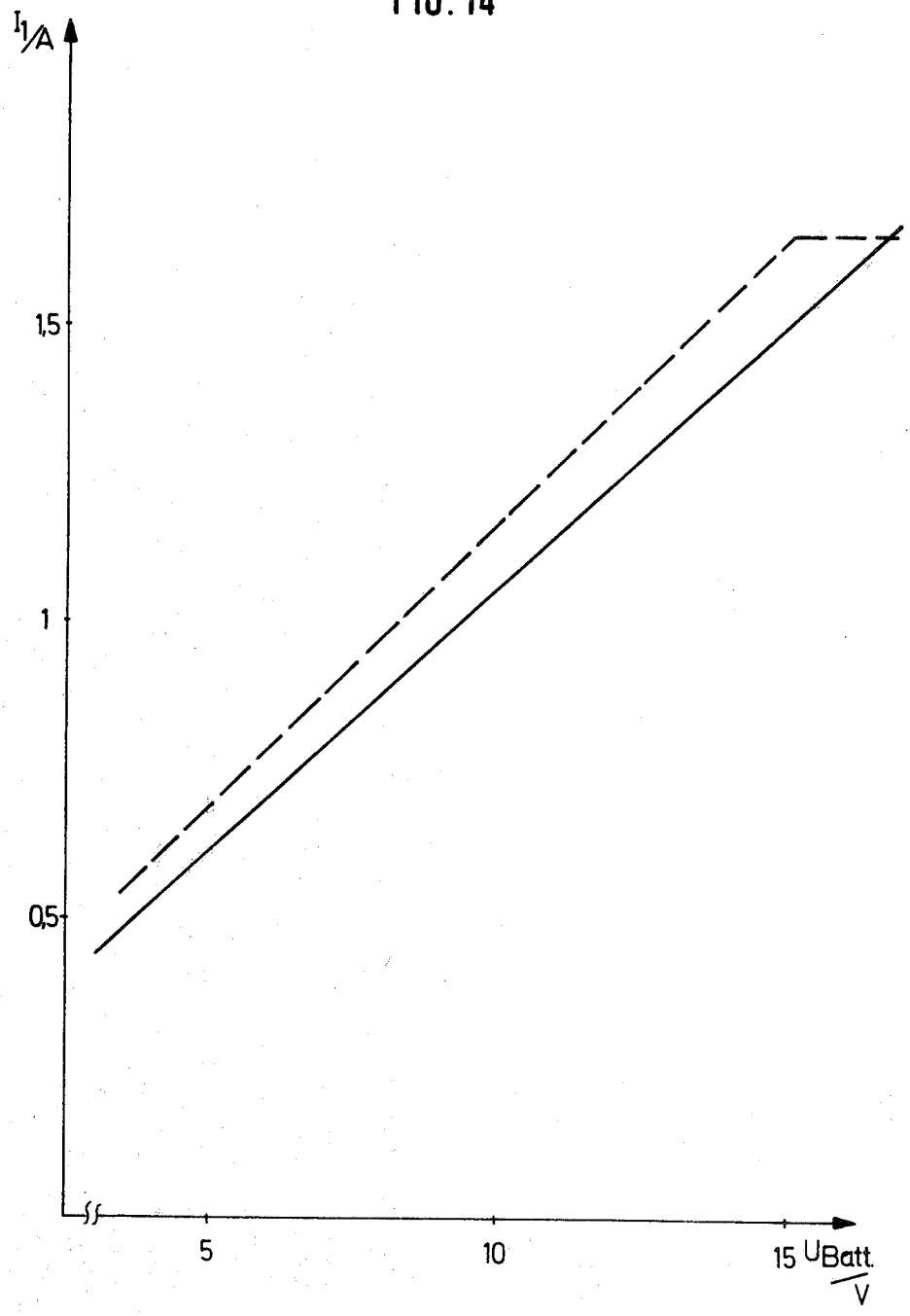
FIG. 14 illustrates the nominal initial current as a function of battery voltage.

It may be seen from the illustration of FIG. 14 that the function obeyed by the battery voltage may be taken at any time from the current $I_1$ at the moment of actuation of the valves. In order to insure that, when valves within certain tolerances are used, all of the valves definitely actuate even using a single current-controlled output circuit, the decrease of the current to the maintenance value $I_H$ from the terminal initial value I1 can take place only if the valve currents have definitely exceeded this limiting value, namely the limiting values of I1 which have just been reached by valves with different tolerances. Obviously, if the valve current were reduced to the maintenance level prior to its responding, the valve would no longer be actuated. Accordingly, FIG. 14 illustrates a dashed line which is the characteristic controller curve $I1 = f(U_{battery})$ which is at at distance of approximately 10 percent with respect to the limiting line. The defined voltage of the actual I1 characteristic curve is useful for providing a safety gap for any battery voltage but without getting too large. Any increase of the current after the valve has actually responded means an additional current loading and a limiting of the precise controllability of the output current for short $t_i$ pulses, as already mentioned. Thus it is desirable to limit the increase which is required for a reliable actuation of valves with manufacturing tolerances.

A further provision of the apparatus of the present invention is the limitation of the increase of the current I1 beginning with a battery voltage of approximately 15 volts. Any increase of the battery voltage above 15 volts in the present exemplary embodiment can occur in a vehicle only in situations of malfunction so that, in the present exemplary embodiment, the current I1 is limited to a maximum absolute value of 1.67 amperes per valve so that one obtains a definite limitation of the collector current of the output transistor T11 as well as of the energy stored in the valve which is equal to $W=\frac{1}{2}\cdot LI^2$. The stored energy is released in a power loss in the subsequent quenched switch-off of the output transistor T11. Thus, the current limitation permits an optimum choice of the output transistors with respect to maximum collector current and pulse power.

If the output of the set-point switching circuit 34 is low, then the diodes D35 and D34 are blocked and the resistors R73 and R72 are without current. The lower set-point which corresponds to the maintenance current is then provided only by the voltage divider consisting of the resistors R66, R65 and R67.

The set-point switch circuit 34 which is connected behind the controller in principle also consists of a bistable flip-flop of the same construction as in the first exemplary embodiment. However, this flip-flop is triggered through a diode D38 from the output of the inverter or comparator B6 of the driver circuit 39 which is still high during a pause between injection pulses. Thus, as soon as the $t_i$ pulse is terminated, the flip-flop which acts as the set-point switching circuit is triggered into a position which causes the output P20 of the comparator B8 to be at high potential. By using the information of the pause between the $t_i$ pulse, the set-point switching circuit 34 may be statically triggered by a diode instead of being triggered at the starting edge of the $t_i$ pulse which would require an R-C-D member. The flip-flop is reset through the diode D39 and the resistor R76 by the output of the comparator B7 as in the first exemplary embodiment.

Once the valve current reaches the value I1, the controller output B12 switches up for the first time and sets the set-point switching circuit 38 back into the position in which its output P20 is at low or zero potential.

In addition, there is connected behind the set-point switching circuit 34 a delay circuit for the free-running control which includes a further comparator B9. If, at the end of the $t_i$ pulse, the set-point switching circuit 34 jumps to high potential, then the capacitor C15 is recharged through the diode D40 with low impedance while its other end is grounded through a resistor R77. Because of the presence of this resistor, the inverting input of the comparator B9 receives a voltage jump so that the output P21 of the comparator B9 can immediately follow the positive triggering edge of the output of the comparator B8. The delay time for delaying the response of the free-running circuit 31 is then produced by the fact that the diode D40 is blocked and the capacitor C15 is recharged through the resistors R78 and R79 until the potential at the inverting input of the comparator B9 is more negative than the potential fixed by the resistors R80/R81 at the non-inverting input. Only then does the output P21 go to high potential and the subsequent transistor T20 is caused to conduct, thereby connecting the base of the transistor T15 of the free-running circuit 31 to ground and causing this transistor as well as the subsequent transistor T16 to conduct. This produces the delay time $t_v$, shown in FIG. 10*f*, until the free-running circuit is turned on, thereby producing the abrupt decay of the current from the maximum value I1 to the maintenance value. The free-running circuit then remains turned on from the time t14 until the time t3, i.e., during the controlled phase of the valve current regulation.

The foregoing relates to preferred exemplary embodiments of the invention, it being understood that other variants and embodiments thereof are possible within the spirit and scope of the invention.

What is claimed is:

1. In an apparatus for controlling solely the actuation current supplied to an electrical device, in particular to one or more electromagnetic fuel injection valves having actuating coils which respond to fuel injection control pulses supplied by the fuel injection system of an internal combustion engine, the duration of said pulses being dependent substantially on engine air throughput and engine speed (rpm) and said duration of said pulses determining the amount of fuel admitted by said valves, said apparatus including positive and negative power supply lines;

an output circuit connected to the actuating coils of the fuel injection valves for providing actuation of said fuel injection valves, said output circuit having a fully conducting or a fully turned off state, said output circuit including:

a feedback-controlled driver and logic circuit for receiving said fuel injection control pulses from said fuel injection system; and sensing means for sensing the actual magnitude of the actuation current in the actuating coils of said injection valves and for generating a control variable as a function thereof, the improvement comprising:

a feedback circuit including: a two-point controller circuit connected to said driver and logic circuit and to said sensing means for receiving the control variable from said sensing means; and a set-point switching circuit for receiving trigger pulses coincident with said fuel injection control pulses, said set-point switching circuit being connected to said two-point controller circuit for providing an increased set-point signal to said two-point controller circuit at the beginning of each fuel injection control phase, said two-point controller circuit serving to render said output circuit either fully conducting, at least when the beginning of a fuel injection control pulse is received by the feedback-controlled driver and logic circuit, or fully turned-off.

2. An apparatus as defined by claim 1, wherein said driver and logic circuit includes two sequential amplifier stages and wherein an output of said two-point controller circuit is connected to an input of said second stage of said feedback-controlled driver and logic circuit.

3. An apparatus as defined by claim 1, further comprising a controlled free-running circuit and a quenching circuit connected in parallel to the actuating coils of said fuel injection valves.

4. An apparatus as defined by claim 3, wherein said quenching circuit includes a diode (D2) and a resistor (R9) connected between said actuating coils and one of the power supply lines of the apparatus and wherein said free-running circuit is so connected with a first stage of said driver and logic circuit as to be active whenever one of said fuel injection control pulses is present.

5. An apparatus as defined by claim 4, wherein said free-running circuit includes at least one semiconductor element, having a collector-emitter path of which is connected in parallel with said actuating coils of said injection valves.

6. An apparatus as defined by claim 6, wherein said sensing means senses the instantaneous value of the acutation current in the actuating coils of said injection valves.

7. An apparatus as defined in claim 6, wherein said sensing means is a resistor (R10) connected in series with said actuating coils of said injection valves and to a positive one of said supply lines of said apparatus which generates a voltage drop corresponding to the current flowing through said actuating coils, wherein said two-point controller circuit includes a differential amplifier (B1) and a voltage divider circuit, one tap of which is connected to the differential amplifier, said voltage drop corresponding to the current flowing through said actuating coils being fed to the voltage divider circuit.

8. An apparatus as defined in claim 7, wherein the set-point signal is a set-point voltage, wherein said differential amplifier has inverting and non-inverting inputs and an ouput, and wherein the non-inverting input of said differential amplifier (B1) receives the set-point voltage for said apparatus.

9. An apparatus as defined by claim 8, which includes at least three separate circuit members each of which has an additive influence to the instantaneous value of said set-point voltage and wherein said apparatus further includes a voltage divider (R17,R18) which feeds a portion of said set-point voltage to the remaining input of said differential amplifier (B1).

10. An apparatus as defined by claim 9, wherein said three separate circuit members, generating a portion of the set-point voltage, includes, in series connection, a Zener diode (D3), a diode (D4) and a resistor (R11), all connected between the positive and negative supply lines (16, 15), and wherein the junction of the diode (D4) and the resistor (R11) is connected through a further resistor (R12) to a resistor (R13) across which is carried the set-point voltage at a point (P3).

11. An apparatus as defined by claim 10, wherein said differential amplifier (B1) has a feedback loop, wherein the output of said differential amplifier (B1) is connected in series with a resistor (R21) and a diode (D7) which is connected in series with a further resistor (R16) to generate a hysteresis behavior of said two-point controller circuit, and wherein the junction of the diode (D7) and the resistor (R16), of the feedback loop of said differential amplifier (B1), is connected via a diode (D6) to the junction point of said Zener diode (D3) and said diode (D4).

12. An apparatus as defined by claim 9, wherein the set-point switching circuit comprises a multivibrator (6) for switching said set-point voltage, and connected to be set by the front edge of each of said fuel injection control pulses, said multivibrator (6) having an output (P6) connected over a feedback diode (D90), connected in series with two resistors (R14, R15), to a circuit point (P3) which carries said set-point voltage.

13. An apparatus as defined by claim 12, wherein the junction of said resistors (R14 and R15) is connected through a diode (D5) to the junction point of said Zener diode (D3) and said diode (D4).

14. An apparatus as defined by claim 13, wherein said set-point voltage may be so adjusted that the valve actuation current initially follows an exponential function.

15. An apparatus as defined by claim 14, further comprising energy storage means associated with said multivibrator (6) for changing the set-point voltage provided to said two-point controller circuit.

16. An apparatus as defined by claim 14, wherein said multivibrator (6) includes an operational amplifier (B2) having inverting and non-inverting inputs and the output (P6) and voltage divider circuits connected to both of the inputs of said operational amplifier (B2), and wherein said operational amplifier (B2) is connected to receive a triggering pulse generated from the front edge of said fuel injection control pulse via a capacitor (C2) and a resistor (R16) which form an R-C member as well as to a diode (D9).

17. An apparatus as defined by claim 16, wherein said multivibrator (6) is a bistable multivibrator in which the input not receiving said fuel injection control pulse is connected to the output ($P_5$) of said two-point controller circuit; whereby said multivibrator returns to its initial state at the first switchover of said two-point controller circuit.

18. An apparatus as defined by claim 1, further comprising a free-running circuit (31) and a quenching circuit (D24, D25) connected in parallel with the actuation coils of said electromagnetic fuel injection valves, wherein said output circuit includes an output transistor (T11), said free-running circuit (31) and said quenching circuit (D24, D25) are connected so as to be selectively actuated during the blockage of said output transistor (T11), and wherein said quenching circuit (D24, D25) is activated while said free running circuit (31) is blocked.

19. The apparatus as defined by claim 18, wherein said output transistor (T11) has an emitter, base and collector and said quenching circuit includes the series connection of two Zener diodes (D24, D25) connected between the collector and the base of said output transistor (T11), and wherein one of the Zener diodes (D24) is shunted by a capacitor (C10); whereby when said output transistor (T11) is blocked, the magnetic storage effect of the actuating coils of said fuel injection valves increases the collector voltage on said output transistor (T11) to a first lower value ($U_{K1}$) which rises to a final value ($U_{K2}$) after said capacitor (C10) has charged, at which time the actuating current in said fuel injection valves has been substantially reduced for reducing the output power peak of said output transistor (T11).

20. An apparatus as defined by claim 18, further comprising a free-running control circuit (32), wherein said free-running circuit (31) which is connected to the collector of said output transistor (T11) can be turned on, by the free-running control circuit (32), at a time later than the time at which the actuating current in said fuel injection valves has been quenched and lowered to a second value (I4).

21. An apparatus as defined by claim 1, wherein said sensing means is a measuring resistor (R41) connected to an emitter of an output transistor (T1) and to the lower of the two voltage supply lines of said apparatus and wherein the coil of at least one of said electromagnetic valves is connected in a collector circuit of said output transistor (T11).

22. An apparatus as defined by claim 21, wherein said two-point controller circuit (35) includes a comparator (B7) having inverting and non-inverting inputs, the non-inverting input of which is connected to said measuring resistor (R41) via a resistor (R50), and wherein the inverting input of said comparator (B7) receives the set-point signal of said apparatus.

23. An apparatus as defined by claim 22, further comprising a timing circuit associated with the connection between said measuring resistor (R41) and the non-inverting input of said comparator (B7).

24. An apparatus as defined by claim 22, wherein there is provided a feedback circuit for said comparator (B7), including resistors (R61, R60) and diodes (D30, D31), said diodes being connected between the output of said comparator (B7) and its non-inverting input; whereby the signal fed to said non-inverting input of said comparator (B7) may be altered when said two-point controller circuit (35) switches.

25. An apparatus as defined by claim 23, wherein said timer circuit associated with the non-inverting input of said comparator (B7) is connected to a diode (D32) within a feedback loop.

26. An apparatus as defined by claim 22, further comprising a set-point adjustment circuit including series-connected resistors (R60, R61) and a diode (D30) connected to a source of current and connected to the non-inverting input of said compressor (B7) which remains blocked as long as the set-point signal of said actuating valve current is greater than the actual value as sensed by said measuring resistor (R41) and wherein the junction of said resistor (R60) and said diode (D30) is coupled to a further diode (D31) in turn connected to the output of said comparator (B7) for releasing said set-point adjustment circuit whenever said comparator (B7) switches over from a first state; whereby a current which simulates said set-point signal is forced into a resistor (R50) connected in series with said measuring resistor (R41).

27. An apparatus as defined by claim 22, further comprising a supplementary set-point change circuit which includes a capacitor (C11) connected in series with a resistor (R62) and connected to the actual value, non-inverting input of said comparator (B7) and rendered conducting by a further diode (D32) connected to the output of said comparator (B7); whereby when said comparator (B7) switches from a first switching state, the non-inverting input of said comparator receives a simulated, combined set-point signal with a predetermined time constant.

28. An apparatus as defined by claim 22, wherein the set-point switching circuit (34) is connected to said comparator (B7) and includes a comparator (B8) which changes state at the first switching of the output (P12) of said two-point controller circuit.

29. An apparatus as defined by claim 28, wherein an output (P20) of said connector (B8) within said set-point switching circuit (34) is connected back to the set-point input of said comparator (B7) for the purpose of changing the set-point signal after the first response to said two-point controller circuit.

30. An apparatus as defined by claim 29, further comprising a diode (D34) connected through a resistor (R72) to the output of said comparator (B8) as well as to the set-point input of said comparator (B7) through a resistor (R73); whereby said diode (D34) conducts prior to the first switchover of said controller circuit for the purpose of changing said set-point signal.

31. An apparatus as defined by claim 30, further comprising a voltage divider circuit including resistors (R65, R66 and R67) connected to a stabilized source of potential (P15).

32. An apparatus as defined by claim 31, further comprising a diode (D35) connected to said source of stabilized potential (P15) and connected so as to limit the voltage at the set-point input of said comparator (B7).

33. An apparatus as defined by claim 1, further comprising a free-running control circuit (32) including a comparator (B9) and a subsequent transistor (T20), and a delay circuit including a diode (D40), a capacitor (C15), and a resistor (R77) connected to the inverting input of said comparator (B9); whereby said free running circuit (31) is activated, by the free-running control circuit (32), only after the actuation current of the fuel injection valves has decayed to a maintenance level ($I_H$).

34. An apparatus as defined by claim 33, wherein the set-point signal is pulse shaped such that only the negative-going flank edge of the pulse shaped signal is delayed.

35. An apparatus as defined by claim 33, further comprising an NPN Darlington switching transistor constituting an output transistor (T11) of said apparatus, and wherein said free-running circuit (31) includes a PNP transistor (T15) combined with an NPN transistor (T16) both coupled to said output transistor (T11).

* * * * *